US010837227B2

(12) United States Patent
Huang et al.

(10) Patent No.: US 10,837,227 B2
(45) Date of Patent: Nov. 17, 2020

(54) WINDOW SHADE

(71) Applicant: Teh Yor Co., Ltd., New Taipei (TW)

(72) Inventors: Chin-Tien Huang, New Taipei (TW); Chien-Lan Huang, New Taipei (TW)

(73) Assignee: Teh Yor Co., Ltd., New Taipei (TW)

( * ) Notice: Subject to any disclaimer, the term of this patent is extended or adjusted under 35 U.S.C. 154(b) by 322 days.

(21) Appl. No.: 15/952,580

(22) Filed: Apr. 13, 2018

(65) Prior Publication Data

US 2018/0298683 A1 Oct. 18, 2018

Related U.S. Application Data

(60) Provisional application No. 62/485,089, filed on Apr. 13, 2017.

(51) Int. Cl.
*E06B 9/34* (2006.01)
*E06B 9/322* (2006.01)

(52) U.S. Cl.
CPC ..... *E06B 9/322* (2013.01); *E06B 9/34* (2013.01)

(58) Field of Classification Search
CPC ..... E06B 9/34; E06B 2009/405; E06B 2009/2435; E06B 2009/2405; E06B 9/40; E06B 9/322; E06B 9/262; E06B 9/78; E06B 9/56; E06B 9/08; E06B 2009/2627; E06B 9/42
See application file for complete search history.

(56) References Cited

U.S. PATENT DOCUMENTS 8,327,906 B2 * 12/2012 Kwak ..... E06B 9/262 160/121.1
10,415,305 B2 * 9/2019 Huang ..... E06B 9/303
10,443,302 B2 * 10/2019 Huang ..... E06B 9/26
2014/0262066 A1 * 9/2014 Certain ..... E06B 9/26 160/84.02

FOREIGN PATENT DOCUMENTS

KR 20100115293 A 10/2010
KR 101260918 B1 * 5/2013 ..... E06B 9/40
WO 2013122399 A1 8/2013

OTHER PUBLICATIONS

International Search Report dated Jul. 2, 2018 in parent application PCT/US2018/027509.
Written Opinion of the International Searching Authority dated Jul. 2, 2018 in parent application PCT/US2018/027509.

* cited by examiner

*Primary Examiner* — Daniel P Cahn
*Assistant Examiner* — Jeremy C Ramsey
(74) *Attorney, Agent, or Firm* — Chen Yoshimura LLP

(57) ABSTRACT

A window shade includes a reel coupled to a first control module and connected with a panel assembly, a lift actuator coupled to a second control module, and a switchable coupling mechanism. The panel assembly has an open state for light passage and a closed state blocking light passage. The first control module can drive the reel in rotation for winding and unwinding the panel assembly. The second control module can drive the lift actuator in rotation for switching the panel assembly to the open or closed state. The coupling mechanism has a coupling state in which it rotationally couples the lift actuator to the first control module, and an uncoupling state in which it rotationally uncouples the lift actuator from the first control module. The coupling mechanism is in the uncoupling state while the panel assem- (Continued)

bly is closed, and in the coupling state while the panel assembly is opened.

18 Claims, 18 Drawing Sheets

WINDOW SHADE

CROSS-REFERENCE TO RELATED APPLICATION(S)

This U.S. Patent Applications claims priority to U.S. Provisional Patent Application No. 62/485,089 filed on Apr. 13, 2017, the disclosure of which is incorporated herein by reference.

BACKGROUND

1. Field of the Invention

The present invention relates to window shades.

2. Description of the Related Art

Many types of window shades are currently available on the market, such as roller shades, Venetian blinds and honeycomb shades. Conventionally, the window shade is provided with an operating cord that can be actuated to raise and lower the window shade. Certain types of window shades may include a panel assembly having multiple transversal strips that may be adjusted to close or open the panel assembly. This function requires a suitable actuating mechanism provided in the window shade. Usually, window shade products available on the market adopt a design that can open the panel assembly for light passage only after it is lowered to its bottommost position, which may not be convenient to use.

Therefore, there is a need for a window shade that is convenient to operate and address the aforementioned issues.

SUMMARY

The present application describes a window shade that is convenient to operate. The window shade includes a reel coupled to a first control module, a panel assembly connected with the reel, a lift actuator coupled to a second control module, and a switchable coupling mechanism. The panel assembly includes a plurality of transversal vanes respectively connected with a first and a second panel, the panel assembly having an open state for light passage and a closed state blocking light passage. The first control module is operable to drive the reel in rotation for winding and unwinding the panel assembly. The second control module is operable independently from the first control module to drive the lift actuator in rotation, the lift actuator being rotatable in a first direction to urge the first panel to slide relative to the second panel for switching the panel assembly to the open state, and in a second direction to release the first panel for switching the panel assembly to the closed state. The coupling mechanism has a coupling state and an uncoupling state, the coupling mechanism rotationally coupling the lift actuator to the first control module in the coupling state, and rotationally uncoupling the lift actuator from the first control module in the uncoupling state. The window shade has a first configuration in which the panel assembly is in the closed state and the coupling mechanism is in the uncoupling state, and a second configuration in which the panel assembly is in the open state and the coupling mechanism is in the coupling state.

According to another aspect, the window shade includes a reel coupled to a first control module, a panel assembly connected with the reel, a lift actuator coupled to a second control module, and a switchable coupling mechanism. The first control module is operable to drive the reel in rotation. The panel assembly includes a plurality of transversal vanes respectively connected with a first and a second panel, the panel assembly having an open state for light passage and a closed state blocking light passage, and the reel being rotatable to wind and unwind the panel assembly. The second control module is operable independently from the first control module to drive the lift actuator in rotation, the lift actuator being rotatable in a first direction to urge the first panel to slide relative to the second panel for switching the panel assembly to the open state, and in a second direction to release the first panel for switching the panel assembly to the closed state. The coupling mechanism has a coupling state and an uncoupling state, the coupling mechanism rotationally coupling the lift actuator to the first control module in the coupling state, and rotationally uncoupling the lift actuator from the first control module in the uncoupling state. In the window shade described herein, the first control module is operable to drive the lift actuator in rotation for switching the panel assembly from the open state to the closed state while the coupling mechanism is in the coupling state, the coupling mechanism being switched to the uncoupling state when the panel assembly reaches the closed state, and the second control module is operable to drive the lift actuator in rotation and cause the coupling mechanism to switch between the coupling state and the uncoupling state.

DETAILED DESCRIPTION OF THE EMBODIMENTS

Figure 1:
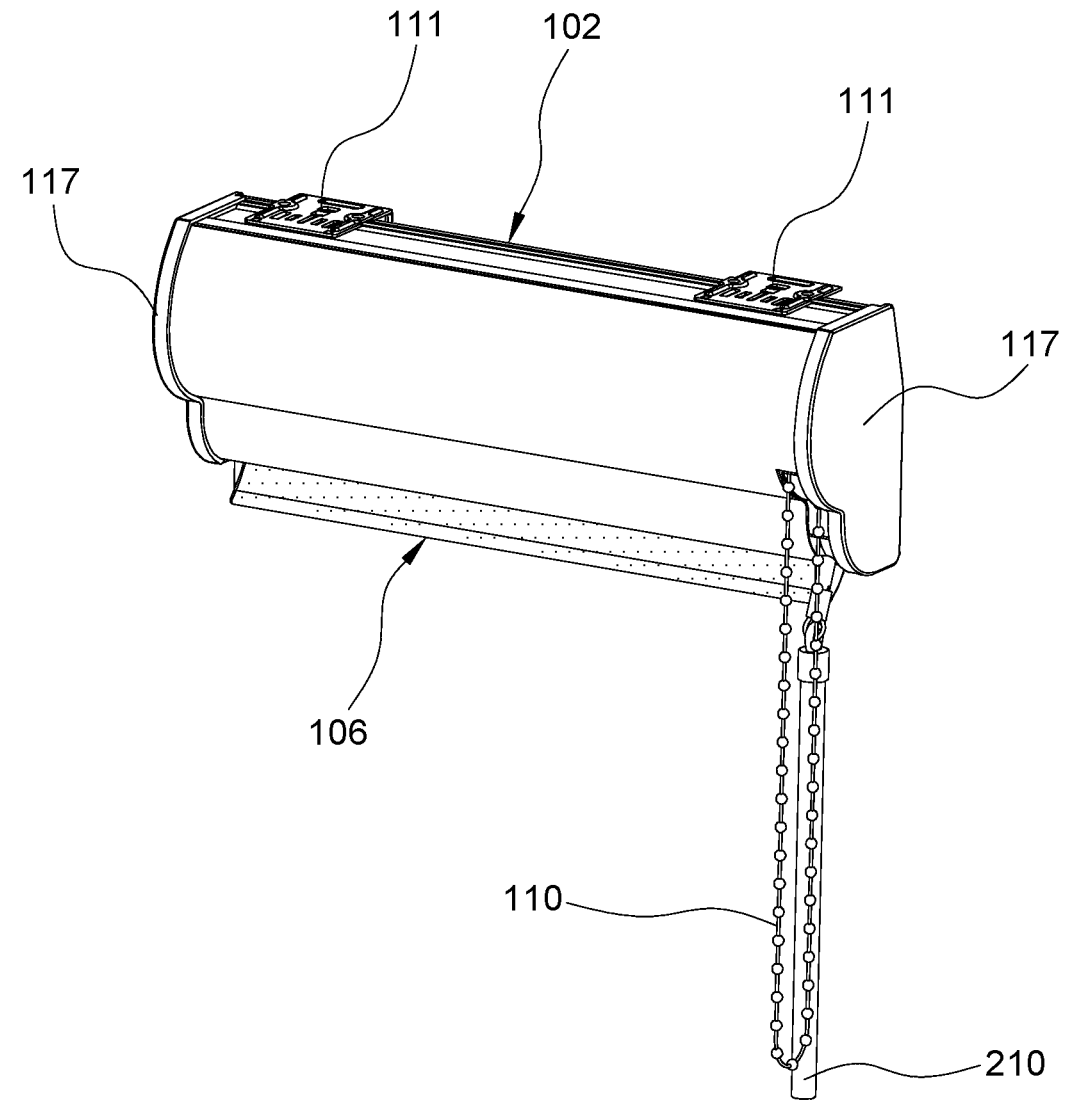
FIG. 1 is a perspective view illustrating an embodiment of a window shade in a fully raised or retracted state.
Figure 2:
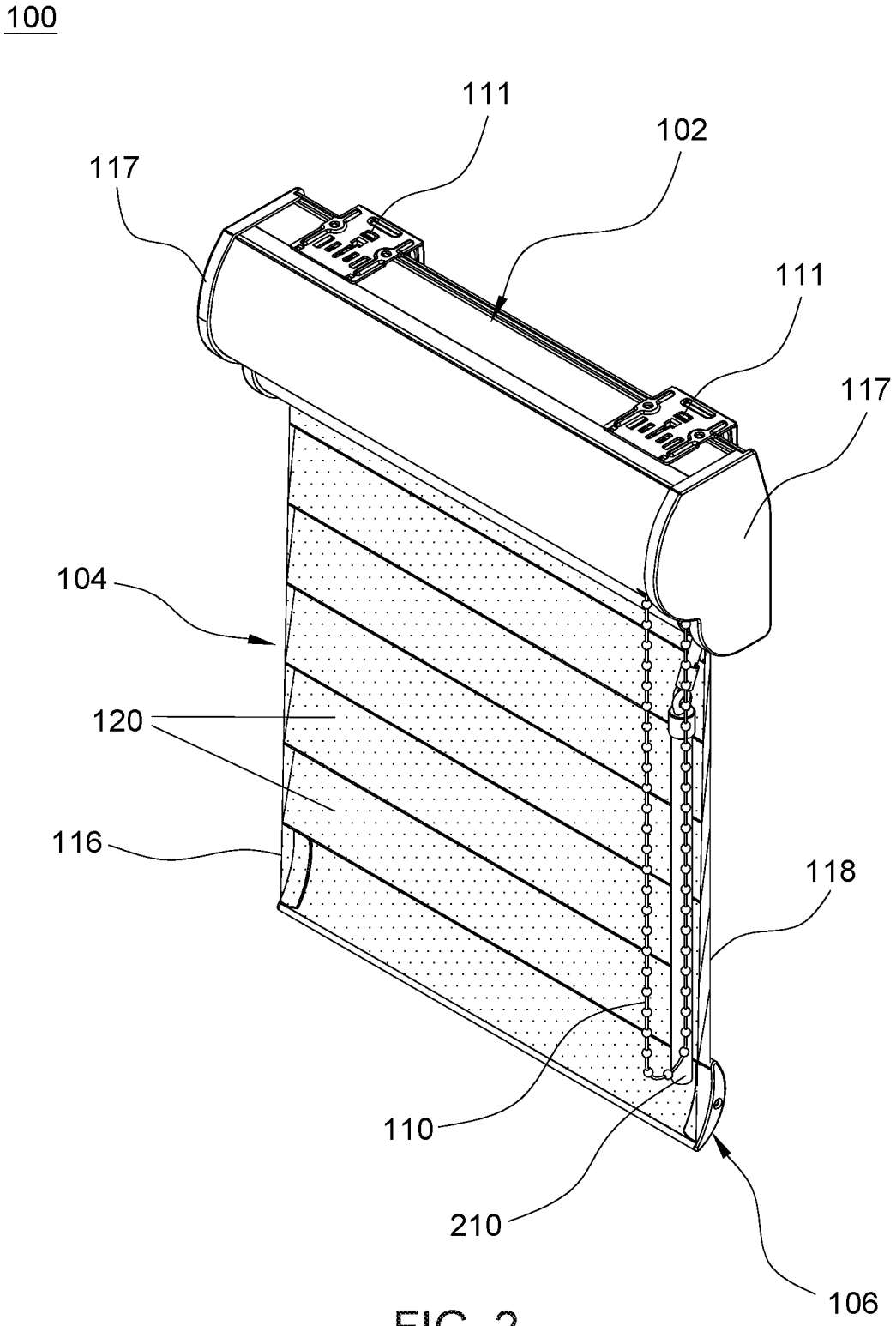
FIG. 2 is a perspective view illustrating the window shade in a lowered and closed state.
Figure 3:
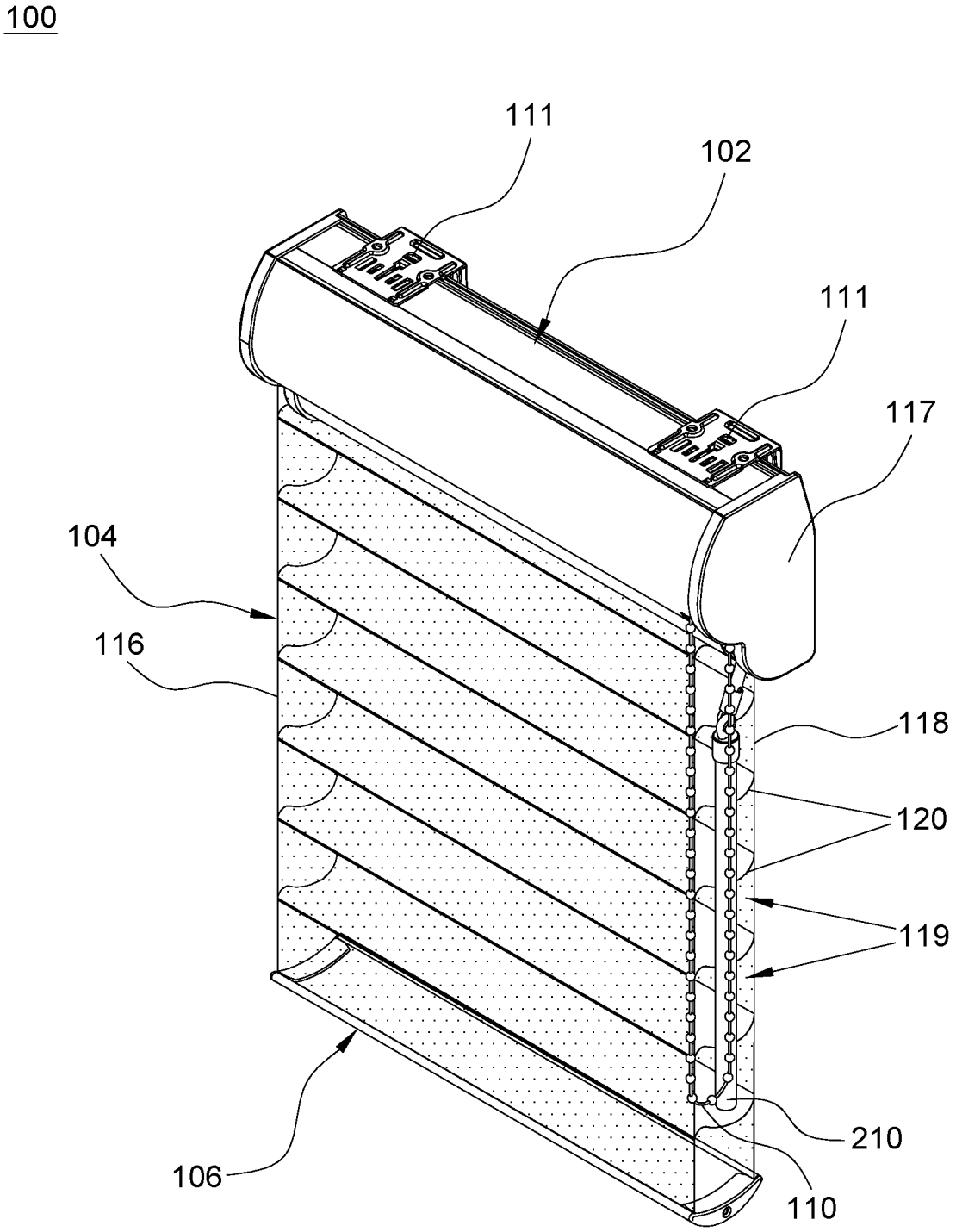
FIG. 3 is a perspective view illustrating the window shade in a lowered and open state.
Figure 4:
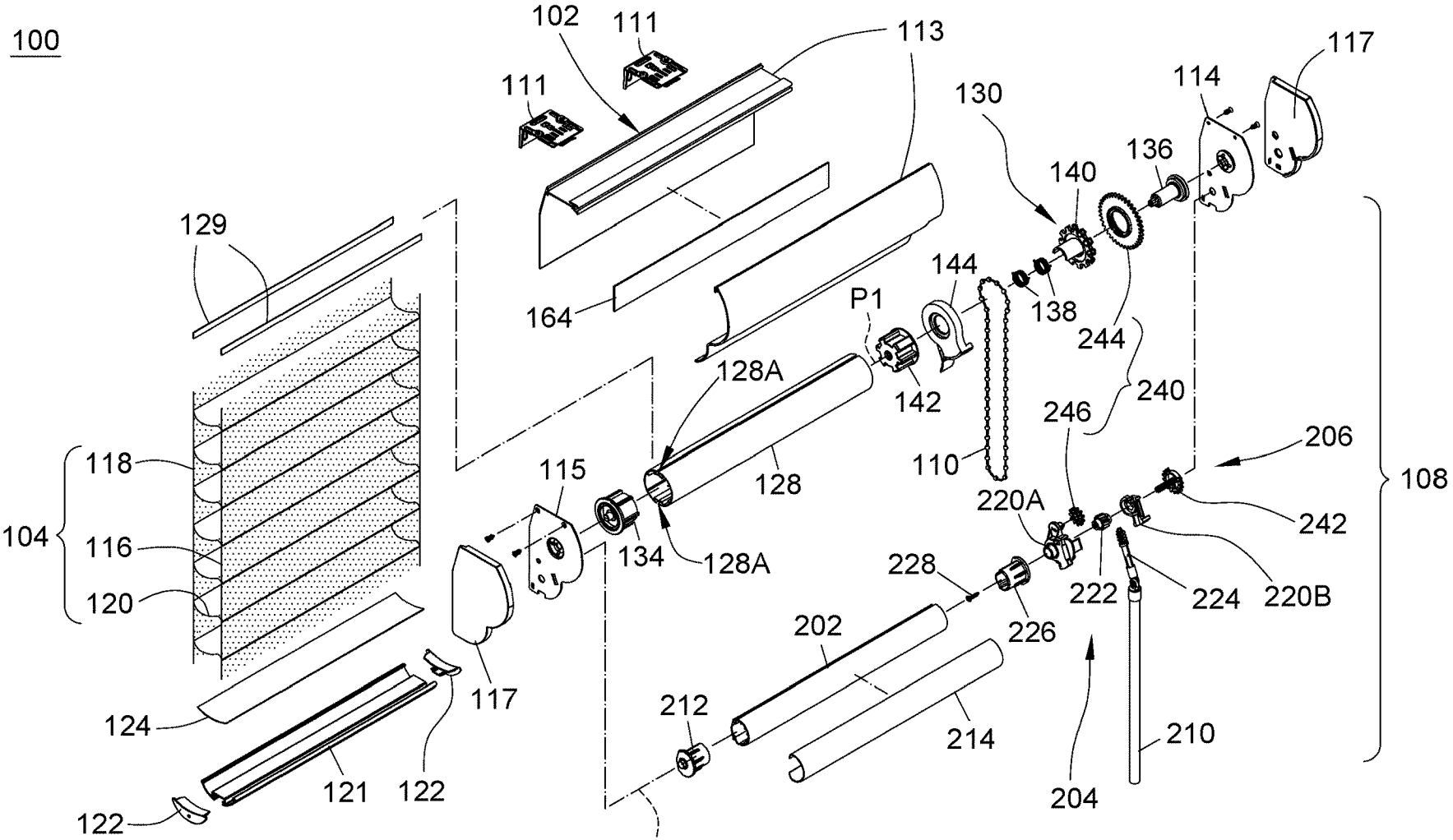
FIG. 4 is an exploded view illustrating a construction of the window shade.
Figure 5:
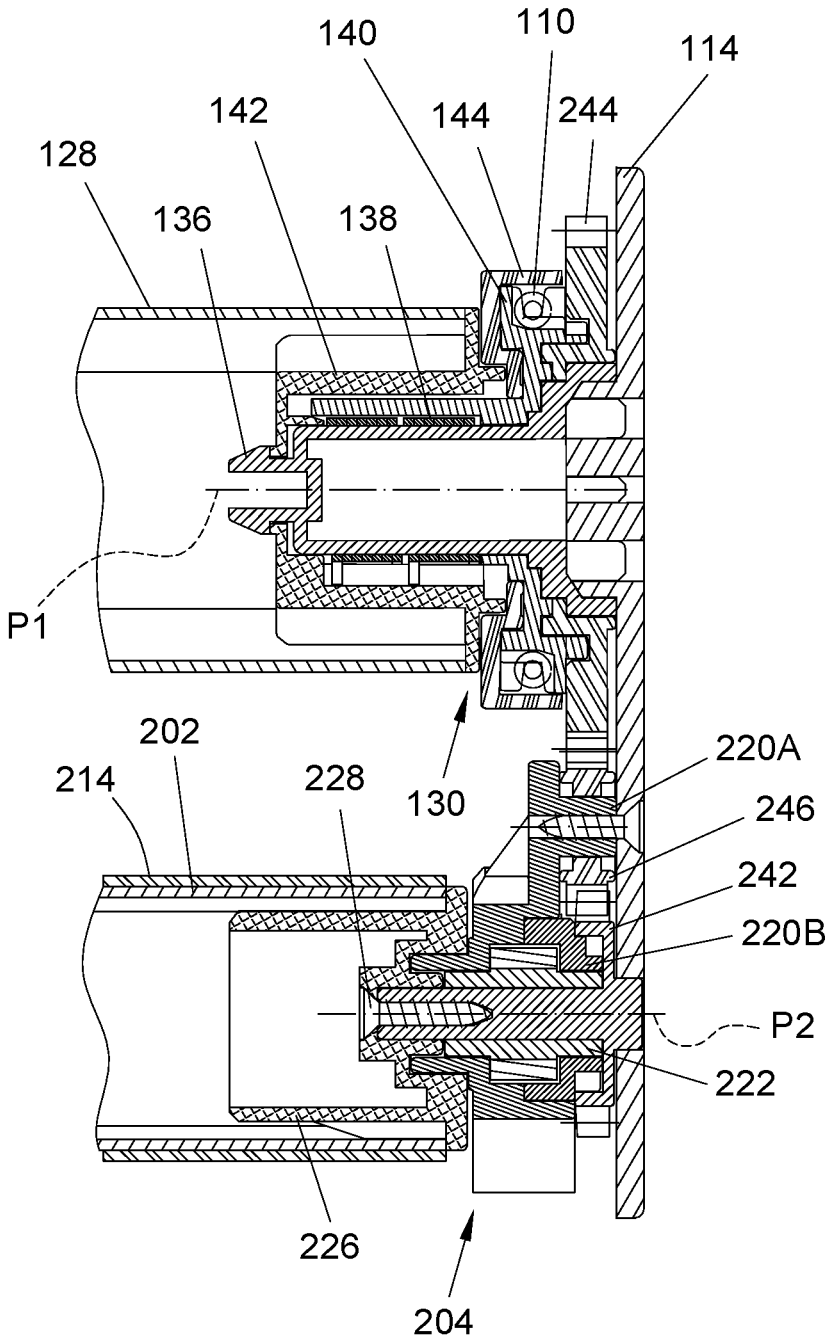
FIG. 5 is a cross-sectional view illustrating the construction of an actuating system provided in the window shade.

FIGS. 1-3 are perspective views respectively illustrating an embodiment of a window shade 100 in a fully raised or retracted state, a lowered and closed state, and a lowered and open state. FIG. 4 is an exploded view illustrating a construction of the window shade 100. Referring to FIGS. 1-4, the window shade 100 can include a head frame 102, a panel assembly 104, a bottom part 106, and an actuating system 108 including two operating members 110 and 210 for controlling the movements of the panel assembly 104.

The head frame 102 may be affixed at a top of a window frame, and can have any desirable shapes. According to an example of construction, the head frame 102 can include a cover 113, and two opposite side caps 114 and 115 respectively connected fixedly with a right and a left end of the cover 113. The head frame 102 can have an inner cavity for at least partially receiving the actuating system 108 of the window shade 100. Moreover, two end covers 117 may be respectively affixed at the left and right end of the head rail 102 to conceal the side caps 114 and 115, thereby providing protection and aesthetic appearance. When the window shade 100 is installed on a window, attachment brackets 111 can be used to affix the head frame 102 on the window frame.

The panel assembly 104 can have an upper and a lower end respectively connected with the actuating system 108 and the bottom part 106. The panel assembly 104 can include two panels 116 and 118, and a plurality of parallel transversal vanes 120. Each of the two panels 116 and 118 can have a width extending generally horizontally, and a length perpendicular to the width. The transversal vanes 120 are disposed between the two panels 116 and 118, and are respectively connected with the two panels 116 and 118 along the length of the two panels 116 and 118. According to an example of construction, the two panels 116 and 118 and/or the transversal vanes 120 may be made of flexible materials including, but not limited to, fabric materials, web materials, mesh materials, and the like. In some implementation, the two panels 116 and 118 may exemplary include a transparent or translucent fabric material, and the transversal vanes 120 may include an opaque material. The panel assembly 104 can be retracted toward an interior of the head frame 102, and expanded or lowered outside the head frame 102. When the panel assembly 104 is expanded or lowered outside the head frame 102 at any given height, the panel assembly 104 is further switchable between a closed state and an open state by imparting a relative displacement between the two panels 116 and 118 that rotates the transversal vanes 120. When the panel assembly 104 is in the closed state, the transversal vanes 120 are substantially vertical and vertically overlap with one another for blocking light passage, as shown in FIG. 2. When the panel assembly 104 is in the open state, the transversal vanes 120 can be turned generally horizontally parallel to one another and define a plurality of gaps 119 in the panel assembly 104 for light passage, as shown in FIG. 3. The vertical position of the panel assembly 104 and its switching between the closed and open state may be controlled by the actuating system 108, which will be described hereinafter in more details.

The bottom part 106 is disposed at a bottom of the panel assembly 104 as a weighing structure, and is movable vertically along with the panel assembly 104 as the panel assembly 104 is retracted toward or expanded from the head frame 102. Referring to FIG. 4, the bottom part 106 may exemplary include a rigid rail 121 having an elongate shape, and two opposite end caps 122 respectively attached to a left and a right end of the rigid rail 121. For facilitating the attachment of the bottom part 106 to the panel assembly 104, an example of construction may fixedly connect the two panels 116 and 118 with an attachment strip 124, which in turn is fixedly fastened to the bottom part 106.

In conjunction with FIGS. 1-4, FIG. 5 is a partial cross-sectional view illustrating a construction of the actuating system 108. Referring to FIGS. 1-5, the actuating system 108 can include a reel 128, a control module 130 coupled to the reel 128, a lift actuator 202, a control module 204 coupled to the lift actuator 202, and a switchable coupling mechanism 206.

The reel 128 is pivotally supported inside the head frame 102, and is connected with the panel assembly 104, e.g., with the two panels 116 and 118 of the panel assembly 104. According to an example of construction, an outer circumferential surface of the reel 128 can have two slots 128A at two spaced-apart angular positions, and the two panels 116 and 118 can be respectively attached to two elongate strips 129 that are respectively inserted into the two slots 128A for anchoring the panel assembly 104 with the reel 128. Depending on the direction of rotation of the reel 128, the panel assembly 104 can wind around the reel 128 for retraction toward the head frame 102, or unwind from the reel 128 to expand and lower below the head frame 102. The panel assembly 104 can be wound around the reel 128 with the panel 116 at an inner side and the other panel 118 at an outer side. The panels 116 and 118 can respectively correspond to a front and a rear panel when the window shade 100 is installed in a room, the front panel facing an interior of the room, and the rear panel being behind the front panel.

The reel 128 is pivotally connected with the head frame 102 about a pivot axis P1 that extends along the head frame 102. According to an example of construction, the reel 128 may be disposed inside the head frame 102 with an end of the reel 128 fixedly attached to a coupling plug 134, and the coupling plug 134 in turn is pivotally connected with the side cap 115 of the head frame 102. The other end of the reel 128 can be rotationally coupled to the control module 130, which is assembled adjacent to the other side cap 114 of the head frame 102. The control module 130 is operable to drive the reel 128 in rotation about the pivot axis P1 relative to the head frame 102 for winding and unwinding the panel assembly 104.

Figure 6:
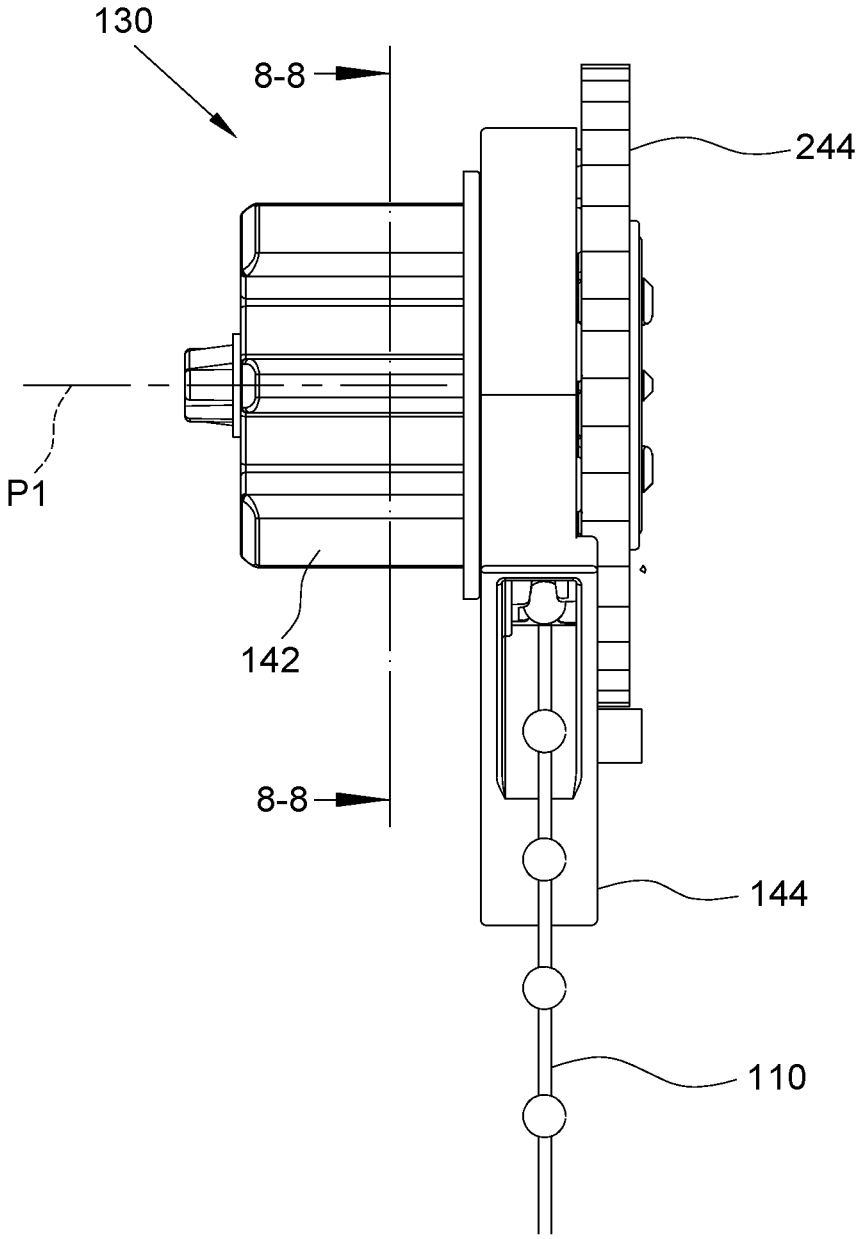
FIG. 6 is a side view of a first control module provided in the actuating system of the window shade.
Figure 7:
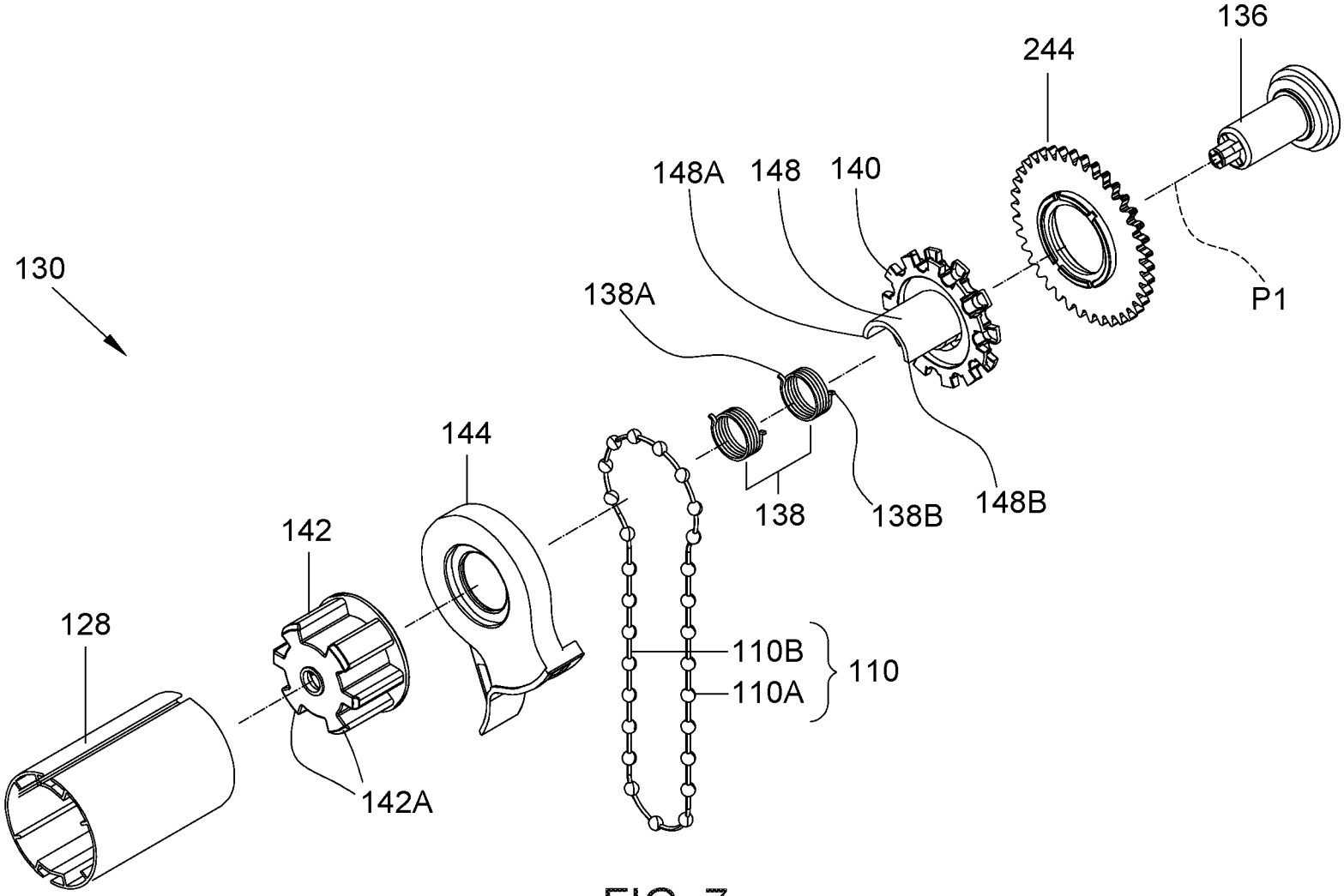
FIG. 7 is an exploded view of the first control module.
Figure 8:
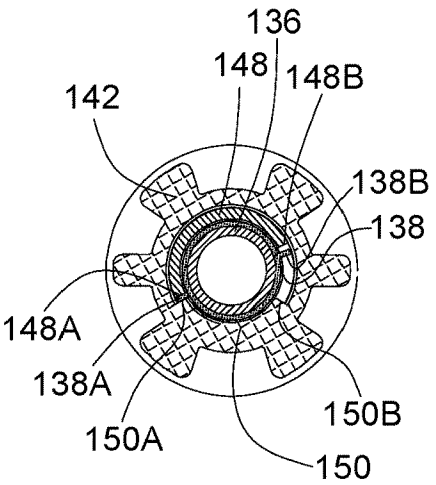
FIG. 8 is a cross-sectional view illustrating further construction details of the first control module along section plane 8-8 shown in FIG. 6.

In conjunction with FIGS. 4 and 5, FIGS. 6 and 7 are respectively a perspective and an exploded view illustrating a construction of the control module 130, and FIG. 8 is a cross-sectional view taken along a section plane 8-8 perpendicular to the pivot axis P1 illustrating further construction details of the control module 130 shown in FIG. 6. Referring to FIGS. 4-8, the control module 130 can include the operating member 110, a fixed shaft member 136, one or more spring 138, an actuating wheel 140, a reel connector 142 and a casing 144. The fixed shaft member 136 can be fixedly attached to the side cap 114 of the head frame 102 coaxial to the pivot axis P1 of the reel 128.

Each spring 138 can be a coiled spring. Each spring 138 can be assembled around the fixed shaft member 136 in tight contact therewith, and can have two prongs 138A and 138B spaced apart from each other. Each of the two prongs 138A and 138B can be respectively pushed in one direction for causing the spring 138 to expand and loosen with respect to the fixed shaft member 136, and in an opposite direction for causing the spring 138 to further contract and tighten on the fixed shaft member 136.

The actuating wheel 140 can have a hole through which is disposed the fixed shaft member 136, whereby the actuating wheel 140 is pivotally supported by the fixed shaft member 136 coaxial to the pivot axis P1 of the reel 128. Accordingly, the actuating wheel 140 can rotate on the fixed shaft member 136 about the pivot axis P1 The operating member 110 is connected with the actuating wheel 140. Upon actuation by a user, the operating member 110 can urge the actuating wheel 140 to rotate about the pivot axis P1, which can drive the reel 128 to rotate for winding or unwinding the panel assembly 104. According to an embodiment, the operating member 110 can be a closed-loop operating member that can wrap at least partially around the actuating wheel 140. For example, the operating member 110 is a bead chain, and the actuating wheel 140 can be a sprocket wheel engaged with the operating member 110. Accordingly, pulling on the operating member 110 can drive the actuating wheel 140 to rotate in either direction. For example, the operating member 110 may have an inner portion 110A and an outer portion 110B, pulling downward the inner portion 110A may drive the actuating wheel 140 to rotate in one direction and pulling downward the outer portion 110B may drive the actuating wheel 140 to rotate in an opposite direction.

The actuating wheel 140 can further be fixedly connected with an protruding part 148, which can wrap partially around the fixed shaft member 136 and have two opposite side edges 148A and 148B. According to an example of construction, the actuating wheel 140 and the protruding part 148 may be formed integrally as a single part. The protruding part 148 can extend partially around a first region of the spring 138 such that a rotation of the actuating wheel 140 in either direction can result in the protruding part 148 selectively pushing against one of the two prongs 138A and 138B for causing the spring 138 to expand and loosen. For example, the side edge 148A of the protruding part 148 can push against the prong 138A of the spring 138 for causing the spring 138 to loosen when the actuating wheel 140 rotates in a first direction, and the side edge 148B of the protruding part 148 can push against the prong 138B of the spring 138 for causing the spring 138 to loosen when the actuating wheel 140 rotates in a second direction opposite to the first direction.

Referring again to FIGS. 4-8, the reel connector 142 can be rotationally coupled to the reel 128, and can have an opening through which is disposed the fixed shaft member 136, whereby the reel connector 142 is pivotally supported by the fixed shaft member 136 for rotation about the pivot axis P1. According to an example of construction, the reel connector 142 can be provided as a plug which may be inserted into the reel 128, an outer surface of the reel connector 142 being provided with a plurality of teeth 142A that may be engaged with inner teeth provided inside the reel 128 for rotationally coupling the reel connector 142 to the reel 128. The reel connector 142 and the reel 128 thus can rotate in unison for winding and unwinding the panel assembly 104.

Referring to FIG. 8, the reel connector 142 can further have an inner side provided with a rib 150 having two opposite side edges 150A and 150B. According to an example of construction, the rib 150 can be formed integrally with the reel connector 142 as a single part. The reel connector 142 can be disposed with the rib 150 extending partially around a second region of the spring 138 and capable of selectively pushing against either of the two prongs 138A and 138B for causing the spring 138 to contract and tighten on the fixed shaft member 136.

The casing 144 can be affixed with the head frame 102, and can enclose at least partially the actuating wheel 140 with the operating member 110 extending outside the casing 144 and the head frame 102.

Figure 10:
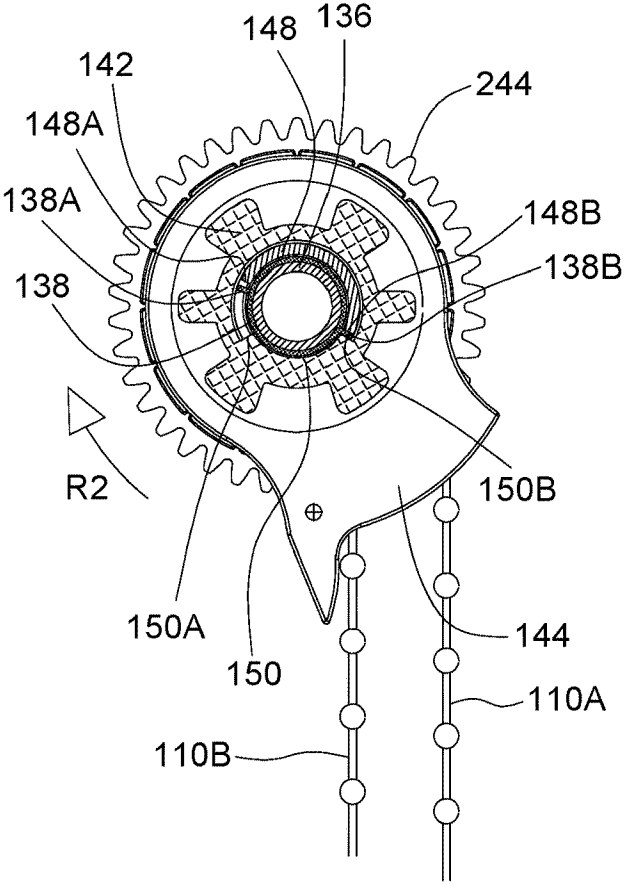
FIGS. 9 and 10 are schematic views illustrating exemplary operation of the first control module.
Figure 9:
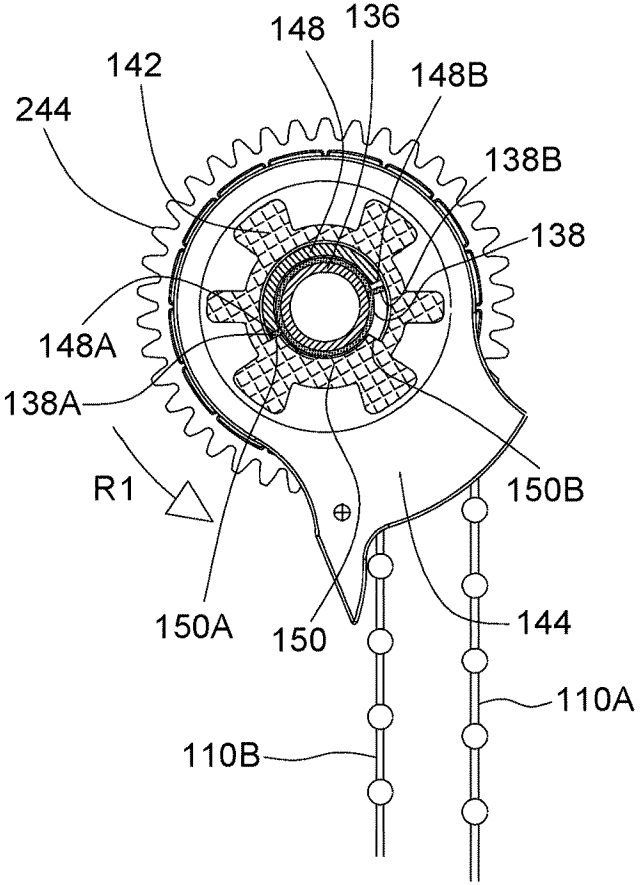

FIGS. 9 and 10 are schematic views illustrating exemplary operation of the control module 130. Referring to FIG. 9, for lowering the panel assembly 104, a user can pull downward one of the inner portion 110A and the outer portion 110B of the operating member 110 (e.g., the outer portion 110B), which urges the actuating wheel 140 to rotate in a direction R1 and cause the protruding part 148 to push against one of the two prongs 138A and 138B for causing the spring 138 to expand and loosen. For example, pulling the outer portion 110B of the operating member 110 downward can cause the side edge 148A of the protruding part 148 to contact and push against the prong 138A of the spring 138, which causes the spring 138 to expand and loosen. As the side edge 148A of the protruding part 148 pushes against the prong 138A of the spring 138, the other side edge 148B of the protruding part 148 moves away from the other prong 138B of the spring 138. The loosened spring 138 then can rotate along with the actuating wheel 140 and push against the rib 150 of the reel connector 142, e.g., via a contact between the prong 138A of the spring 138 and the side edge 150A of the rib 150, which consequently causes the reel connector 142 and the reel 128 to rotate in unison in the same direction along with the spring 138 and the actuating wheel 140 for unwinding and lowering the panel assembly 104. During this unwinding rotation, the prong 138B of the spring 138 may remain out of contact with the side edge 148B of the protruding part 148 and the side edge 150B of the rib 150.

Referring to FIG. 10, for raising the panel assembly 104, a user can pull downward the other one of the inner portion 110A and the outer portion 110B of the operating member 110 (e.g., the inner portion 110A), which urges the actuating wheel 140 to rotate in an opposite direction R2 and causes the protruding part 148 to push against the other one of the two prongs 138A and 138B for causing the spring 138 to expand and loosen. For example, pulling the inner portion 110A of the operating member 110 downward can cause the side edge 148B of the protruding part 148 to contact and push against the prong 138B of the spring 138, which causes the spring 138 to expand and loosen. As the side edge 148B of the protruding part 148 pushes against the prong 138B of the spring 138, the other side edge 148A of the protruding part 148 moves away from the other prong 138A of the spring 138. The loosened spring 138 then can rotate along with the actuating wheel 140 and push against the rib 150 of the reel connector 142, e.g., via a contact between the prong 138B of the spring 138 and the side edge 150B of the rib 150, which consequently causes the reel connector 142 and the reel 128 to rotate in unison in the same direction along with the spring 138 and the actuating wheel 140 for winding and raising the panel assembly 104. During this winding rotation, the prong 138A of the spring 138 may remain out of contact with the side edge 148A of the protruding part 148 and the side edge 150A of the rib 150.

When the operating member 110 is not operated and the actuating wheel 140 remains stationary (e.g., when the panel assembly 104 is positioned at a desired height), the suspended weight of the panel assembly 104 and the bottom part 106 can apply a torque on the reel 128 and the reel connector 142, which biases the rib 150 to push against one of the two prongs 138A and 138B of the spring 138 for causing the spring 138 to contract and tighten on the fixed shaft member 136. While the rib 150 remains in contact against one of the two prongs 138A and 138B, the tightening action of the spring 138 on the fixed shaft member 136 can block rotation of the spring 138, the reel connector 142 and the reel 128 about the pivot axis P1 and keep the panel assembly 104 and the bottom part 106 at any desirable positions, such as the different positions shown in FIGS. 1-3.

Figure 11:
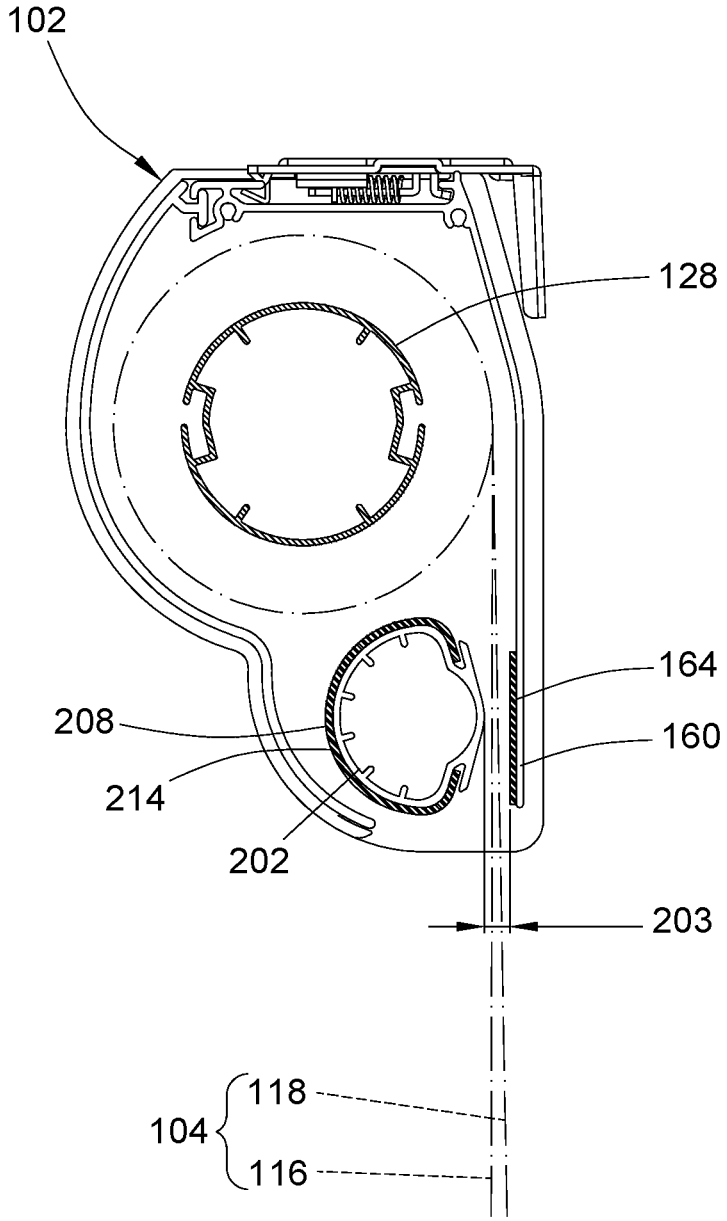
FIG. 11 is a partial cross-sectional view illustrating a lift actuator of the actuating system in a first angular position corresponding to a closed state of a panel assembly of the window shade.
Figure 12:
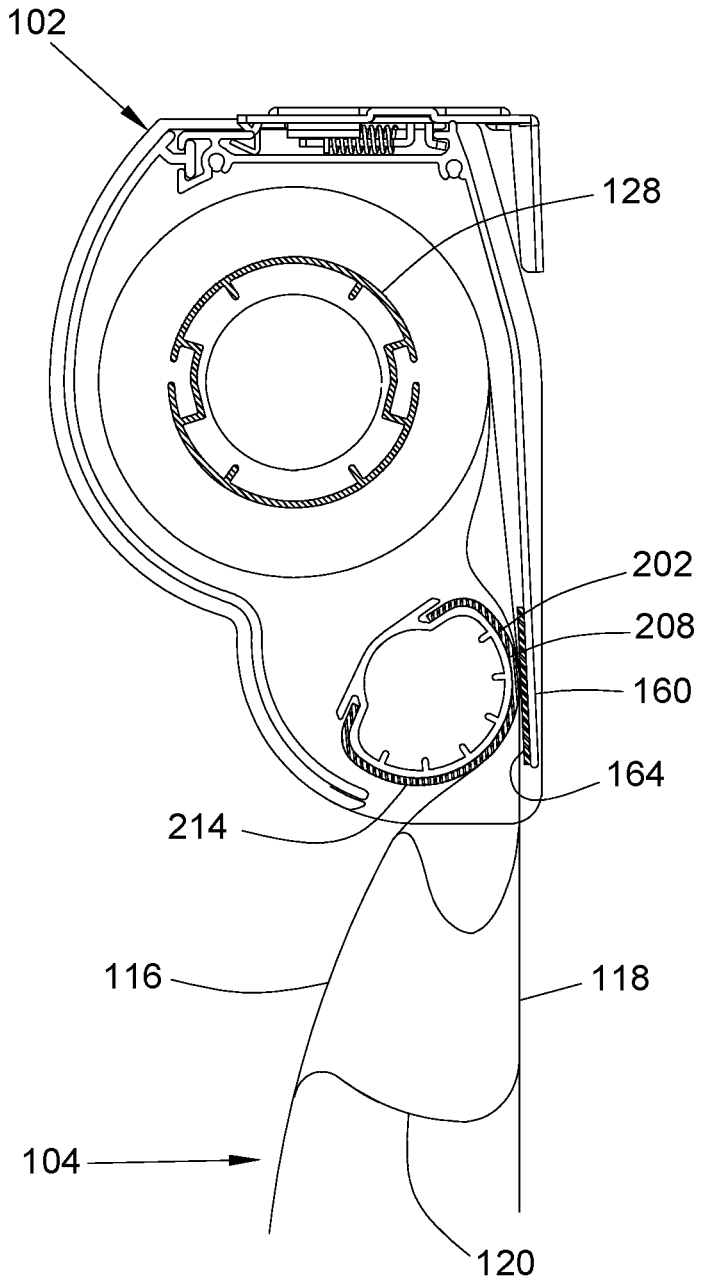
FIG. 12 is a partial cross-sectional view illustrating the lift actuator of the actuating system in a second angular position corresponding to an open state of the panel assembly.
Figure 13:
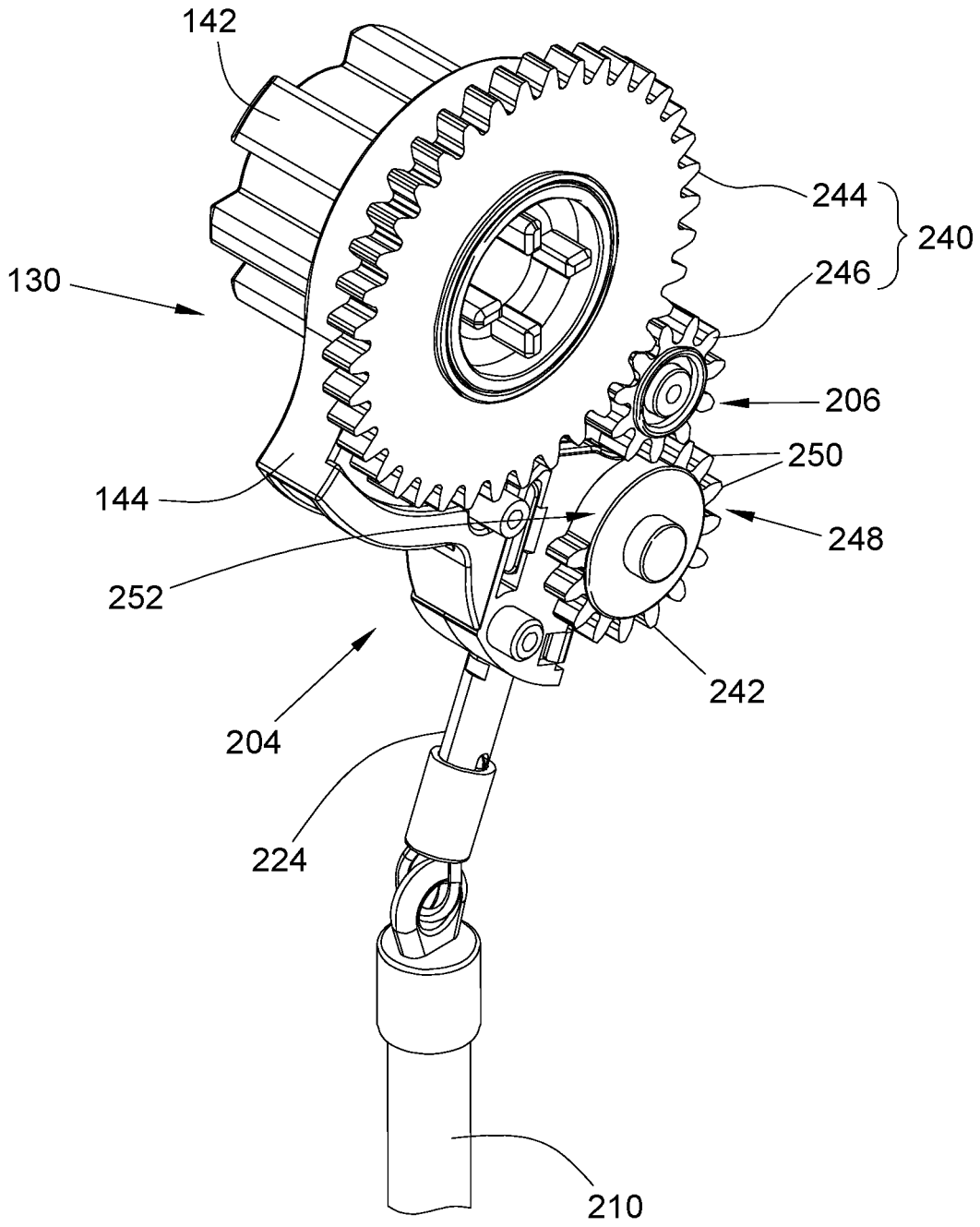
FIG. 13 is a perspective view illustrating a second control module and a coupling mechanism provided in the actuating system of the window shade.
Figure 14:
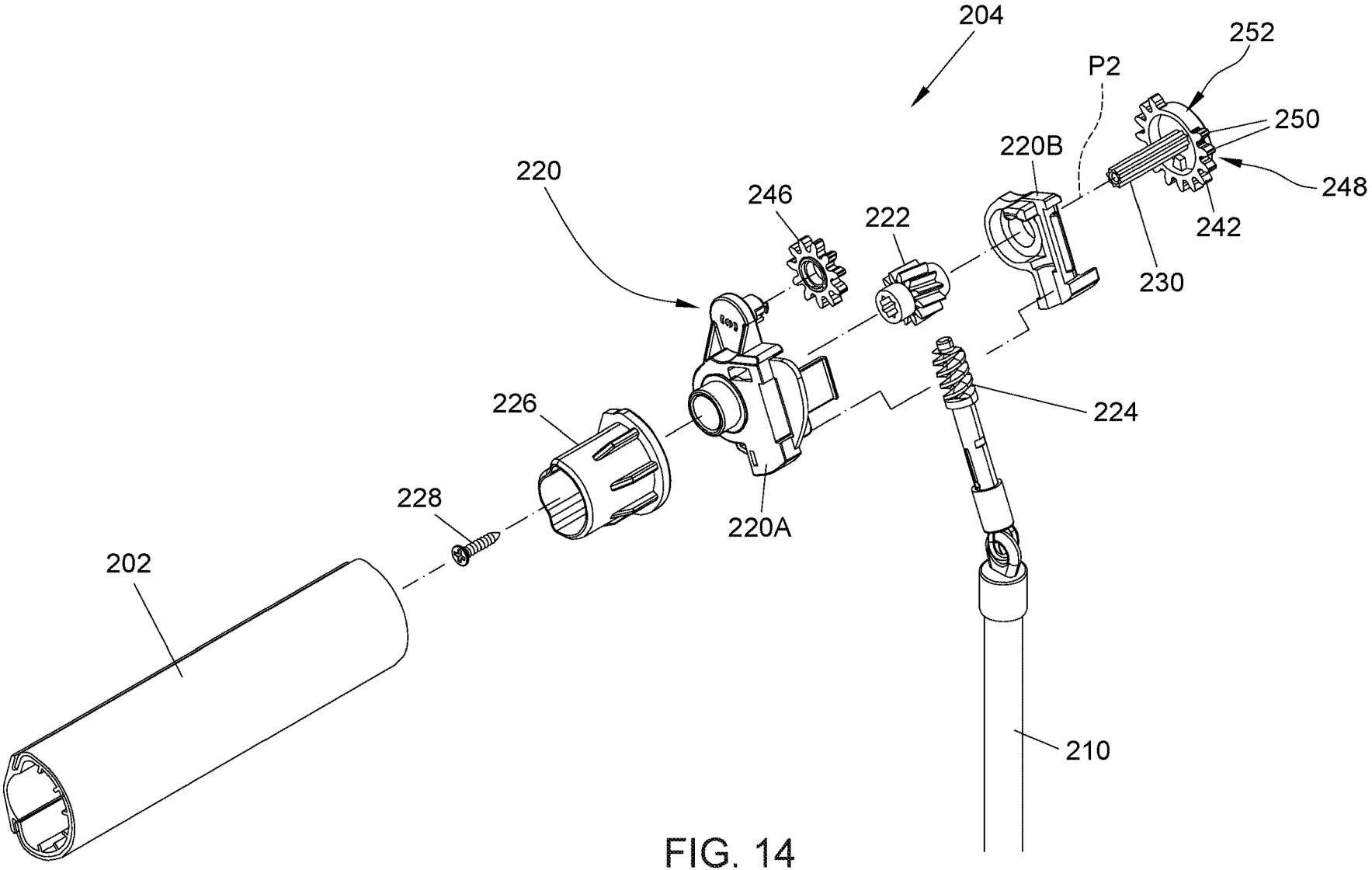
FIG. 14 is an exploded view illustrating some construction details of the second control module and the coupling mechanism.
Figure 15:
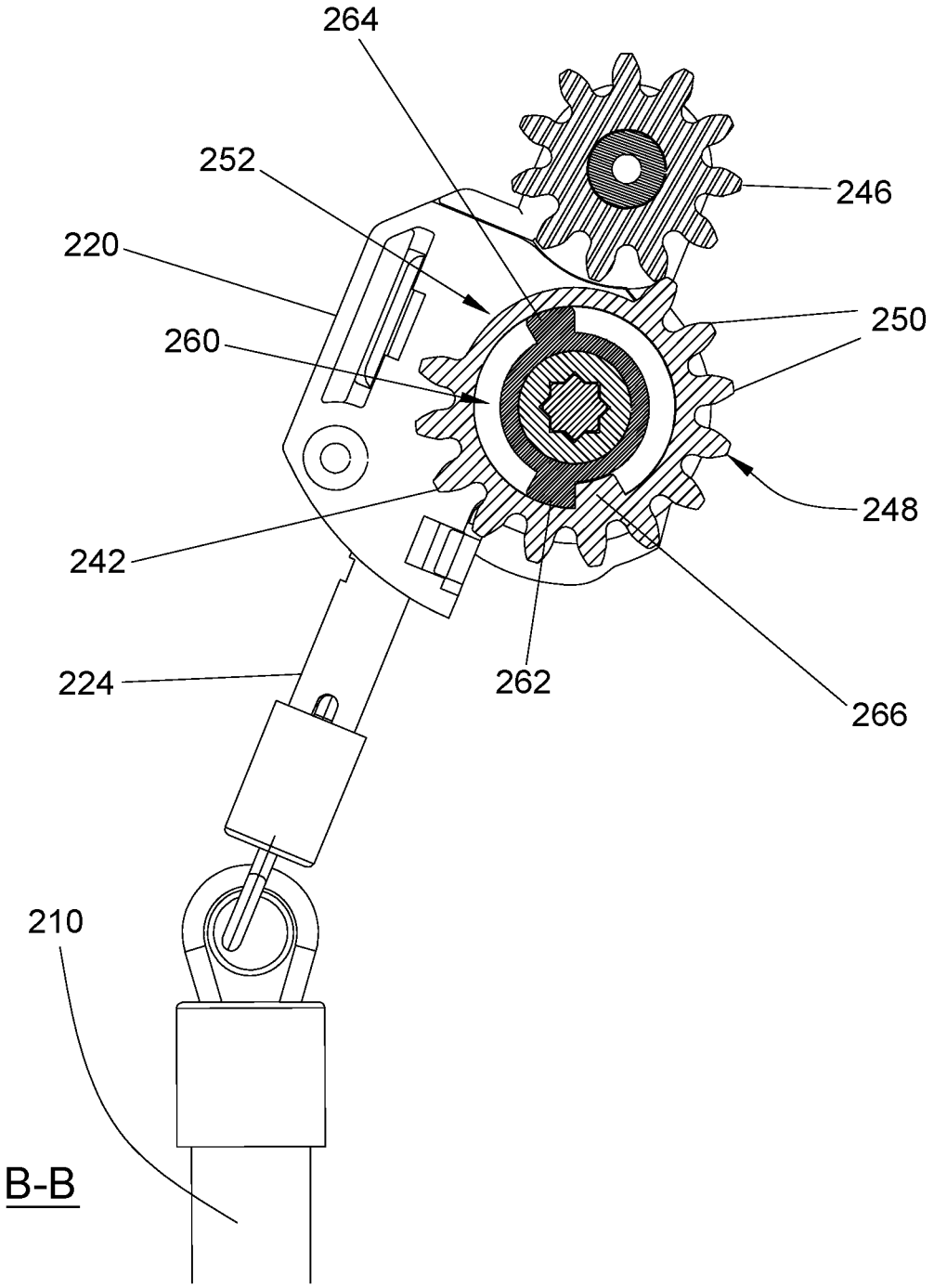
FIG. 15 is a partial cross-sectional view illustrating an embodiment of a limiting structure provided in the actuating system of the window shade.
Figure 16:
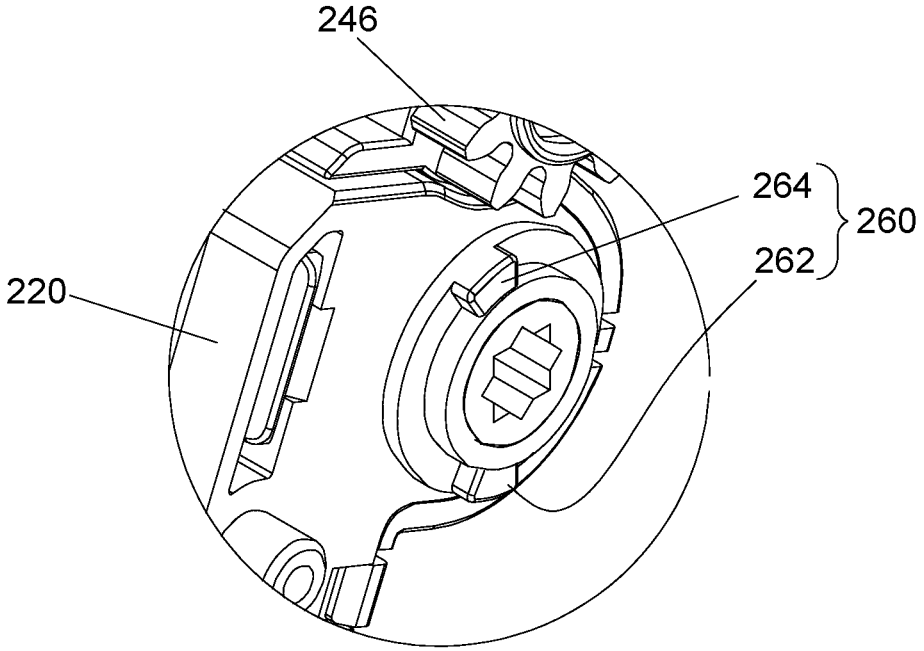
FIG. 16 is a perspective view illustrating the limiting structure.

In conjunction with FIGS. 4 and 5, FIGS. 11 and 12 are partial cross-sectional views illustrating the lift actuator 202 in different angular positions, and FIGS. 13 and 14 are schematic views illustrating construction details of the control module 204 and the coupling mechanism 206. More specifically, FIG. 13 is a perspective view illustrating the control module 204 and the coupling mechanism 206, and FIG. 14 is an exploded view illustrating some construction details of the control module 204 and the coupling mechanism 206.

At any height of the panel assembly 104 and bottom part 106, the lift actuator 202 is independently operable to switch the panel assembly between the closed state and the open state. Referring to FIGS. 4, 5, 11 and 12, the lift actuator 202 is exemplary an elongate tube. An outer surface of the lift actuator 202 can define a clamping surface 208 that can release or clamp the panel assembly 104. The lift actuator 202 can be disposed below the reel 128 and can be pivotally connected with the head frame 102 about a pivot axis P2, the pivot axis P2 of the lift actuator 202 being parallel to the pivot axis P1 of the reel 128 and extending along the length of the head frame 102. According to an example of construction, an end of the lift actuator 202 can be fixedly connected with a coupling plug 212, which in turn is pivotally connected with the side cap 115 of the head frame 102. The other end of the lift actuator 202 can be rotationally coupled to the control module 204, which can be assembled adjacent to the other side cap 114 of the head frame 102. The control module 204 can drive the lift actuator 202 to rotate about the pivot axis P2 relative to the head frame 102, and thereby cause the clamping surface 208 to release or clamp the panel assembly 104 for switching the panel assembly 104 to the closed state or the open state.

FIG. 11 illustrates the lift actuator 202 in a first angular position corresponding to the closed state of the panel assembly 104. In the first angular position shown in FIG. 11, the clamping surface 208 of the lift actuator 202 is displaced away from a sidewall 160 of the head frame 102, which separates the lift actuator 202 from the sidewall 160 of the head frame 102. As a result, the panel assembly 104 can move freely without obstruction through a gap 203 between the lift actuator 202 and the sidewall 160 for adjusting its vertically extended length.

FIG. 12 illustrates the lift actuator 202 in a second angular position corresponding to the open state of the panel assembly 104. In the second angular position shown in FIG. 12, the clamping surface 208 of the lift actuator 202 is positioned adjacent to the sidewall 160 and can urge the panel 116 to slide upward relative to the panel 118, which rotates the transversal vanes 120 and causes the panel assembly 104 to switch to the open state. Moreover, a portion of the panel assembly 104 can be clamped between the clamping surface 208 of the lift actuator 202 and the sidewall 160 with the panels 116 and 118 respectively in contact with the lift actuator 202 and the sidewall 160, which thereby holds the panel assembly 104 in the open state.

As shown in FIGS. 11 and 12, a cross-section of the lift actuator 202 perpendicular to the pivot axis P2 has a non-circular shape, and can be asymmetric relative to the pivot axis P2. In this manner, a rotation of the lift actuator 202 can modify the size of the gap between the lift actuator 202 and the sidewall 160 of the head frame 102, and thereby allow the lift actuator 202 to selectively clamp or release the panel assembly 104. For promoting frictional contact with the panels 116 and 118 of the panel assembly 104, the sidewall 160 of the head frame 102 and the clamping surface 208 of the lift actuator 202 can respectively include friction materials 164 and 214. Examples of friction materials 164 and 214 may include, without limitation, rubber.

The control module 204 is operable independently from the control module 130 to drive the lift actuator 202 in rotation about the pivot axis P2 relative to the head frame 102 between the first angular position shown in FIG. 11 and the second angular position shown in FIG. 12. For example, a rotation of the lift actuator 202 in a first direction from the first angular position of FIG. 11 to the second angular position of FIG. 12 can urge the panel 116 to slide upward relative to the panel 118, thereby switching the panel assembly 104 to the open state. Conversely, a rotation of the lift actuator 202 in an opposite second direction from the second angular position of FIG. 12 to the first angular position of FIG. 11 can release the panel 116, thereby switching the panel assembly 104 to the closed state.

Referring to FIGS. 1-5 and 11-14, the control module 204 can be disposed adjacent to the side cap 114 of the head frame 102 and the control module 130. The control module 204 can include a housing 220, a helical gear 222, a worm rod 224 and the operating member 210. The housing 220 can be formed by two housing portions 220A and 220B assembled with each other, and can be fixedly attached to the side cap 114.

The helical gear 222 can be pivotally connected with the housing 220 and can be rotationally coupled to the lift actuator 202, whereby the helical gear 222 and the lift actuator 202 can rotate in unison about the pivot axis P2 relative to the housing 220. According to an example of construction, an end of the lift actuator 202 can be fixedly connected with a coupling plug 226, and the coupling plug 226 can be pivotally connected with the housing 220 and fixedly attached to a shaft 230 via a screw 228. The helical gear 222 can be rotationally coupled to the shaft 230, the shaft 230 and the helical gear 222 being coaxial to the lift actuator 202. As a result, the shaft 230, the coupling plug 226, the lift actuator 202 and the helical gear 222 can be rotationally coupled to one another, and can rotate together relative to the housing 220.

The worm rod 224 can be meshed with the helical gear 222, and can be pivotally connected with the operating member 210. The operating member 210 can be a rigid wand having one end pivotally connected with the worm rod 224, the operating member 210 extending outside the head frame 102. The operating member 210 can have an elongate shape having a lengthwise axis, and is rotatable along the lengthwise axis to drive the worm rod 224 in rotation, which in turn can cause the helical gear 222, the shaft 230, the coupling plug 226 and the lift actuator 202 to rotate in unison for switching the panel assembly 104 between the closed state and the open state. For example, the operating member 210 can rotate about its lengthwise axis in one direction to cause the panel assembly 104 to switch to the closed state, and in another opposite direction to cause the panel assembly 104 to switch to the open state. Moreover, the operating member 210 can pivot relative to the worm rod 224 for adjustment to different inclination for facilitating manual operation by a user.

With the aforementioned construction, a user can independently operate each of the control modules 130 and 204 for adjustment of the panel assembly 104. In particular, the control module 130 is operable to adjust a vertical extent of the panel assembly 104, the panel assembly 104 remaining in the closed state during the vertical adjustment, and the control module 204 is operable to switch the panel assembly 104 to the closed state or the open state. Because the operating members 110 and 210 are located on a same side of the window shade 100, the control modules 130 and 204 can be conveniently operated for adjusting the panel assembly 104 as desired.

Referring to FIGS. 4-7, 13 and 14, the control module 130 can further be rotationally coupled to the lift actuator 202 via the switchable coupling mechanism 206. More specifically, the coupling mechanism 206 can have a coupling state and an uncoupling state, and is switchable between the coupling state and the uncoupling state. The coupling mechanism 206 can rotationally couple the lift actuator 202 to the control module 130 in the coupling state, and rotationally uncouple the lift actuator 202 from the control module 130 in the uncoupling state. According to an embodiment, the coupling mechanism 206 can include a transmission assembly 240 and a switching part 242.

The transmission assembly 240 is coupled to the control module 130, and can include a plurality of rotatable transmission members 244 and 246. According to an example of construction, the transmission members 244 and 246 can be two gears meshed with each other, the transmission member 244 being rotationally coupled to the actuating wheel 140 of the control module 130. For example, the transmission member 244 can be pivotally supported by the fixed shaft member 136 and can be adjacently connected with the actuating wheel 140, and the transmission member 244, the actuating wheel 140 and the reel 128 can be disposed coaxial to one another. Accordingly, the transmission member 244, the actuating wheel 140 and the reel 128 can rotate in unison about the pivot axis P1 in either direction. The transmission member 246 can pivotally supported by the housing 220, and can be disposed adjacent to the switching part 242. The transmission member 246 is engaged with the transmission member 244, so that both of them can rotate concurrently for drive transmission.

The switching part 242 can have a drive transmission portion 248, and can be rotationally coupled to the lift actuator 202. According to an embodiment, the switching part 242 can be a toothed wheel, and the drive transmission portion 248 can formed on a circumferential region of the switching part 242 and include a plurality of teeth 250. Moreover, the switching part 242 can include a gap 252 adjacent to the drive transmission portion 248, wherein the gap 252 can be greater than a tooth spacing between the teeth 250 in the drive transmission portion 248, and can be provided as a recess on a circumferential region of the switching part 242. According to an example of construction, the shaft 230 is rotationally coupled to the lift actuator 202, and the switching part 242 is fixedly connected with the shaft 230, thereby the switching part 242 can be rotationally coupled to the lift actuator 202. Accordingly, the lift actuator 202 and the switching part 242 can rotate in unison about the pivot axis P2.

With the aforementioned construction, the switching part 242 is movable to close or open the chain of drive transmission provided by the coupling mechanism 206. More specifically, the operating member 210 of the control module 204 is operable to drive the lift actuator 202 and the switching part 242 to rotate in a concurrent manner, which can cause the coupling mechanism 206 to switch between the uncoupling state and the coupling state. In the uncoupling state, the drive transmission portion 248 of the switching part 242 is disengaged from the transmission member 246 of the transmission assembly 240, and the transmission member 246 (e.g., some of the teeth of the transmission member 246) can be partially received in the gap 252 of the switching part 242. Accordingly, the transmission member 246 can rotate through the gap 252 without imparting rotation to the switching part 242 in the uncoupling state. According to an embodiment, the window shade 100 can have a first configuration in which the panel assembly 104 is in the closed state and the coupling mechanism 206 is in the uncoupling state. In this first configuration, the control module 130 is operable to urge the reel 128 in rotation for raising or lowering the panel assembly 104, while the lift actuator 202 can remain stationary in the first angular position shown in FIG. 11. Accordingly, the panel assembly 104 can move upward and downward in the closed state.

When the coupling mechanism 206 is in the coupling state, the drive transmission portion 248 of the switching part 242 is engaged with the transmission member 246 of the transmission assembly 240 (e.g., some of the teeth 250 of the drive transmission portion 248 are meshed with teeth of the transmission member 246), thereby the control module 130 is operable to urge the lift actuator 202 to rotate. According to an embodiment, the window shade 100 can have a second configuration in which the panel assembly 104 is in the open state and the coupling mechanism 206 is in the coupling state. In this second configuration, operation of the control module 130 (in particular for driving the reel 128 to rotate for winding the panel assembly 104) can urge the lift actuator 202 to rotate to the first angular position shown in FIG. 11 via drive transmission through the coupling mechanism 206, which thereby releases the panel assembly 104 and allows its switching to the closed state for facilitating winding of the panel assembly 104 around the reel 128. The switching part 242 also rotates along with the lift actuator 202, so that the coupling mechanism 206 can switch from the coupling state to the uncoupling state when the panel assembly 104 reaches the closed state.

Figure 17:
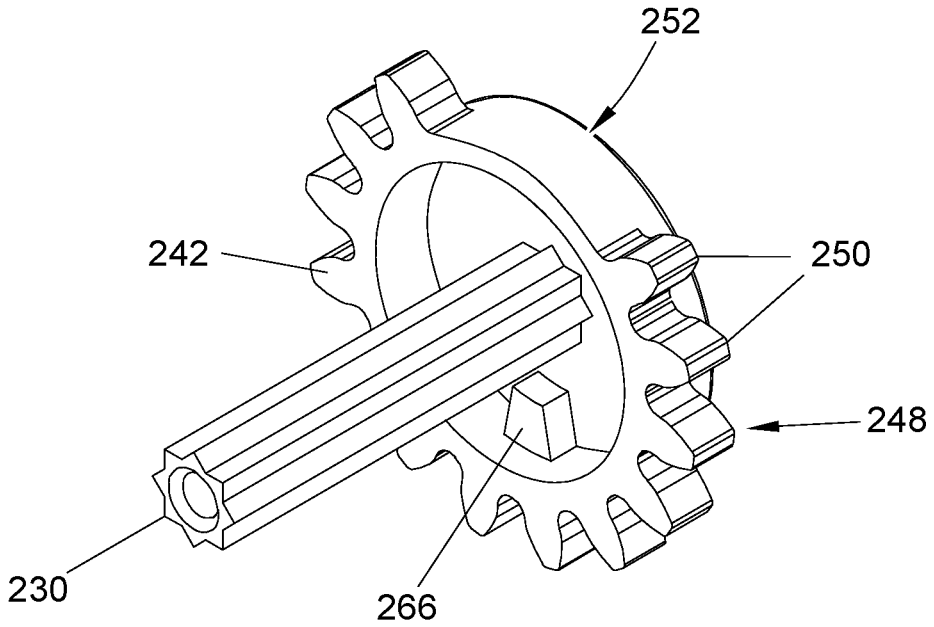
FIG. 17 is a perspective view illustrating some construction details of a switching part provided in the coupling mechanism.

In conjunction with FIGS. 4 and 11-14, FIGS. 15 and 16 are a partial cross-sectional and a perspective view illustrating an embodiment of a limiting structure 260, and FIG. 17 is a perspective view illustrating further construction details of the switching part 242. Referring to FIGS. 4 and 11-17, the limiting structure 260 can limit a range of rotational movement of the lift actuator 202 between the first angular position shown in FIG. 11 and the second angular position shown in FIG. 12, and can stop the lift actuator 202 in the closed state and the open state of the panel assembly 104. According to an example of construction, the limiting structure 260 can include two flange surfaces 262 and 264, which can be fixedly connected with the housing 220 and can be respectively placed on two different radial directions relative to the pivot axis P2 of the lift actuator 202. Moreover, the switching part 242 can include a protrusion 266 disposed radially apart from the shaft 230. The protrusion 266 is fixedly connected with the switching part 242, e.g., the protrusion 266 and the switching part 242 can be formed integrally as a single part.

Figure 18:
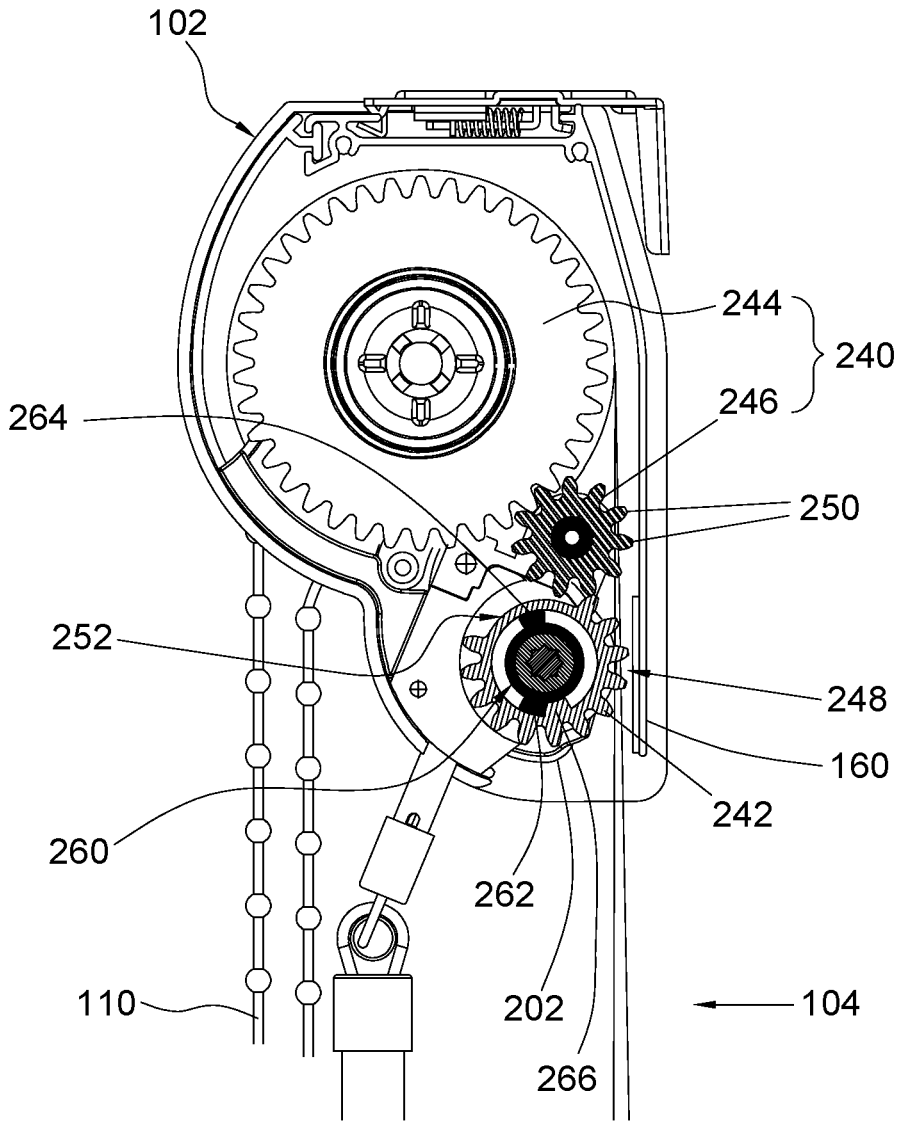
FIGS. 18 and 19 are schematic views illustrating exemplary operation of the limiting structure.

In conjunction with FIGS. 15-17, FIGS. 18 and 19 are schematic views illustrating exemplary operation of the limiting structure 260. Referring to FIG. 18, the flange surface 262 of the limiting structure 260 can stop the lift actuator 202 in the first angular position (shown in FIG. 11) when the panel assembly 104 is in the corresponding closed state. More specifically, the switching part 242 can be stopped by a contact occurring between the protrusion 266 of the switching part 242 and the flange surface 262, which consequently stops the lift actuator 202 rotationally coupled to the switching part 242 in the first angular position, thereby allowing the panel assembly 104 to remain in the closed state.

Figure 19:
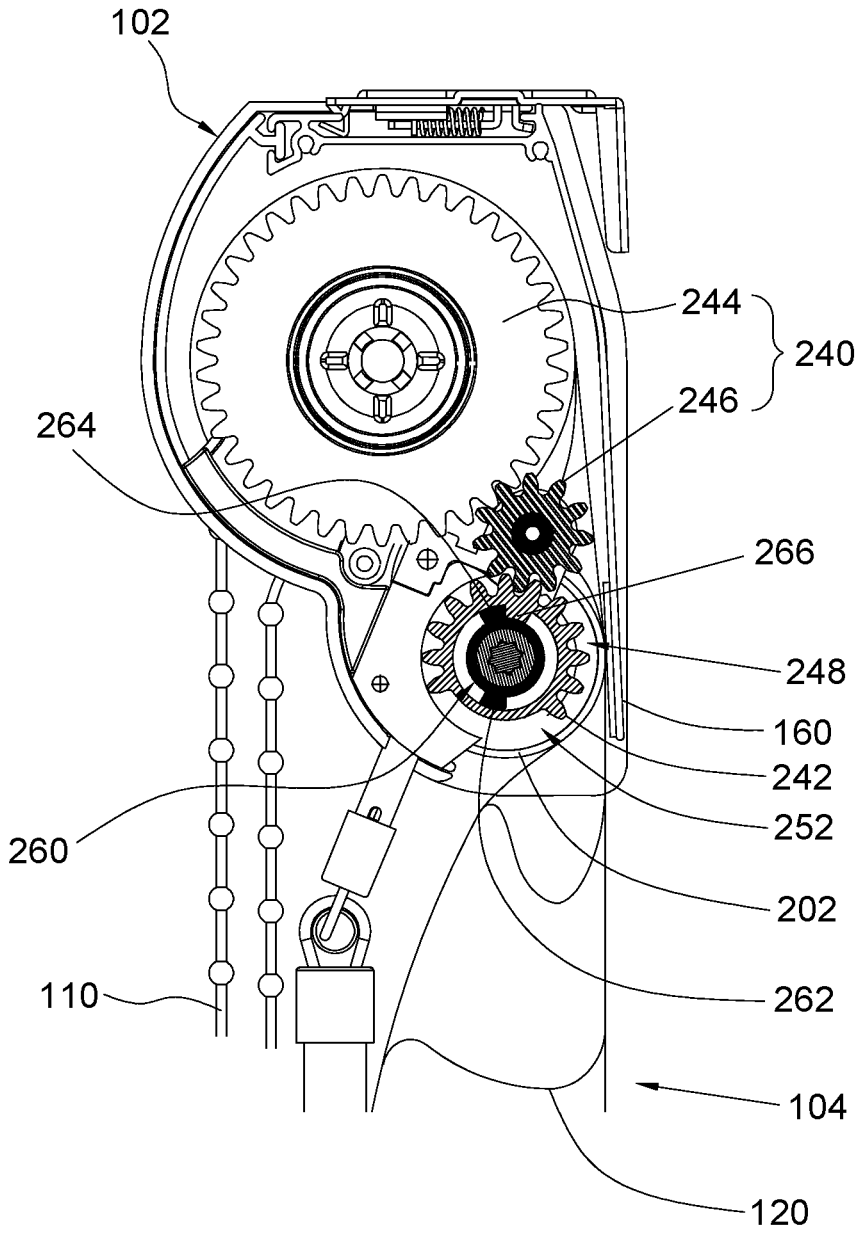

Referring to FIG. 19, the flange surface 264 of the limiting structure 260 can stop the lift actuator 202 in the second angular position (shown in FIG. 12) when the panel assembly 104 is in the corresponding open state. More specifically, the switching part 242 can be stopped by a contact occurring between the protrusion 266 of the switching part 242 and the flange surface 264, which consequently stops the lift actuator 202 rotationally coupled to the switching part 242 in the second angular position, thereby allowing the panel assembly 104 to remain in the open state. As shown in FIG. 19, while the panel assembly 104 is in the open state, the lift actuator 202 is rotationally coupled to the reel 128 owing to the engagement between the drive transmission portion 248 of the switching part 242 and the transmission member 246 of the transmission assembly 240. As a result, the contact between the flange surface 264 of the limiting structure 260 and the protrusion 266 of the switching part 242 can prevent rotation of the lift actuator 202 in the first direction (i.e., similar to the direction for switching the panel assembly 104 to the open state), and at the same time prevent rotation of the reel 128 for winding the panel assembly 104. Accordingly, improper operation of the window shade 100 can be prevented.

Figure 20:
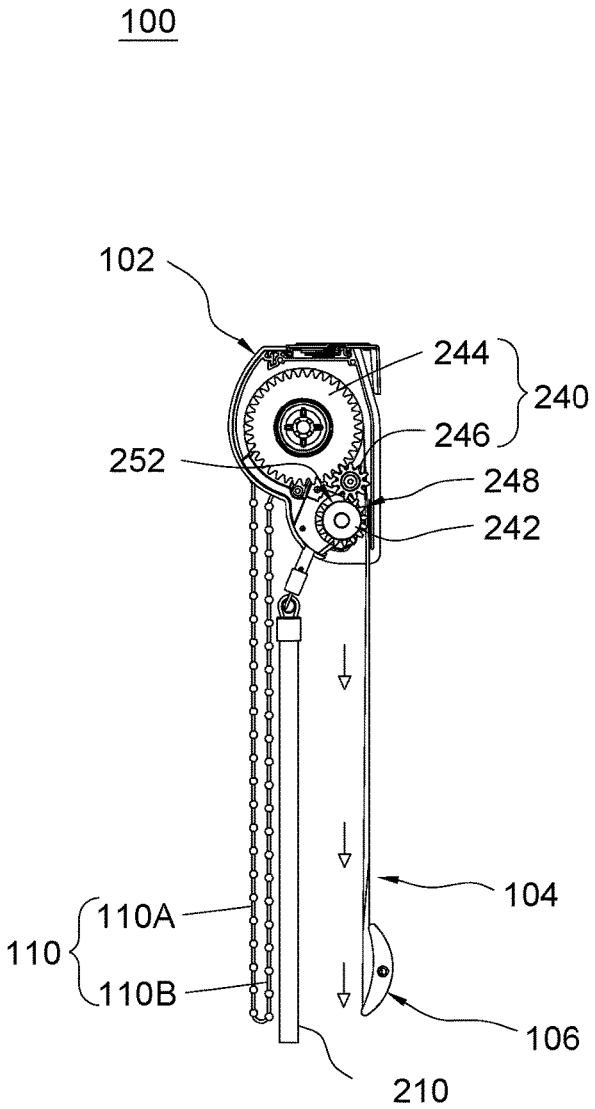
FIGS. 20-23 are schematic views illustrating exemplary operation of the window shade.

In conjunction with FIGS. 1-19, reference is made hereinafter to FIGS. 20-23 for describing exemplary operation of the window shade 100. Referring to FIG. 20, the window shade 100 is shown with the panel assembly 104 in the closed state. For lowering the bottom part 106 and the panel assembly 104 in the closed state, a user can pull downward one of the inner portion 110A and the outer portion 110B of the operating member 110 (e.g., pull the outer portion 110B downward). As a result, the control module 130 can drive the reel 128 in rotation for unwinding the panel assembly 104. In the meantime, the drive transmission portion 248 of the switching part 242 remains disengaged from the transmission member 246 of the transmission assembly 240, so the transmission member 246 can concurrently rotate through the gap 252 of the switching part 242 without imparting rotation to the switching part 242.

Figure 21:
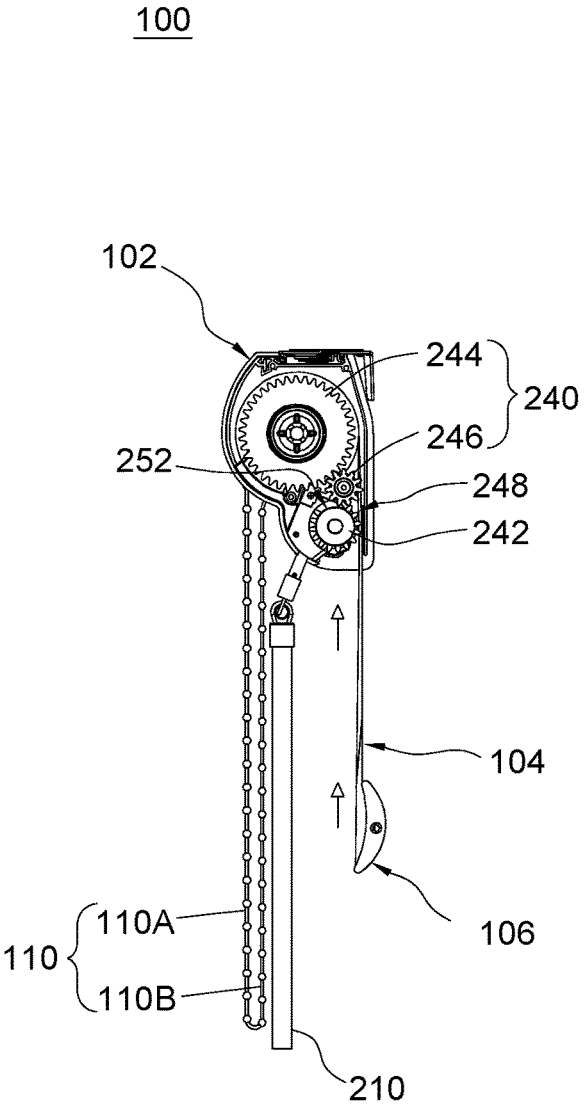

Referring to FIG. 21, for raising the bottom part 106 and the panel assembly 104 in the closed state, a user can pull downward the other one of the inner portion 110A and the outer portion 110B of the operating member 110 (e.g., pull the inner portion 110A downward). As a result, the control module 130 can drive the reel 128 in rotation for winding the panel assembly 104. In the meantime, the drive transmission portion 248 of the switching part 242 remains disengaged from the transmission member 246 of the transmission assembly 240, so the transmission member 246 can concurrently rotate through the gap 252 of the switching part 242 without imparting rotation to the switching part 242.

Figure 22:
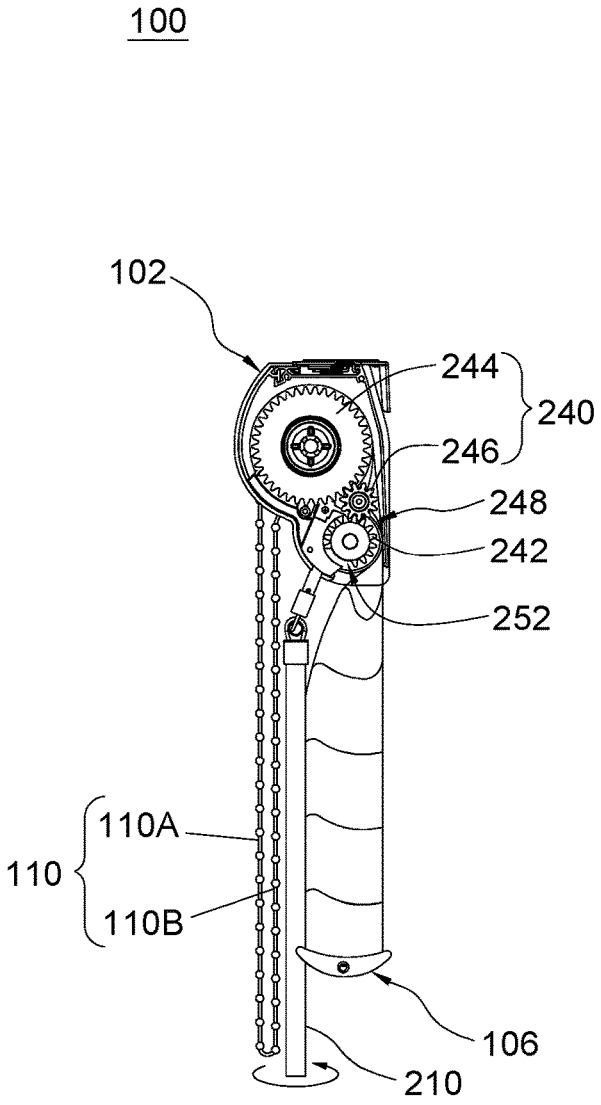

Referring to FIG. 22, the panel assembly 104 can be switched from the closed state to the open state at any height below the head frame 102. For switching the panel assembly 104 from the closed state to the open state, a user can rotate the operating member 210 an angle about its lengthwise axis. As a result, the control module 204 can concurrently drive the lift actuator 202 and the switching part 242 to rotate in unison in a same direction, which causes the panel assembly 104 to switch to the open state and the drive transmission portion 248 of the switching part 242 to engage with the transmission member 246. While the panel assembly 104 remains in the open state, rotation of the reel 128 for winding the panel assembly 104 is prevented owing to the rotational coupling of the lift actuator 202 via the switching part 242 and the transmission assembly 240 to the reel 128 and the blocking contact between the switching part 242 and the limiting structure 260. Accordingly, a user cannot use the operating member 110 for upwardly adjusting the panel assembly 104 in the open state.

Figure 23:
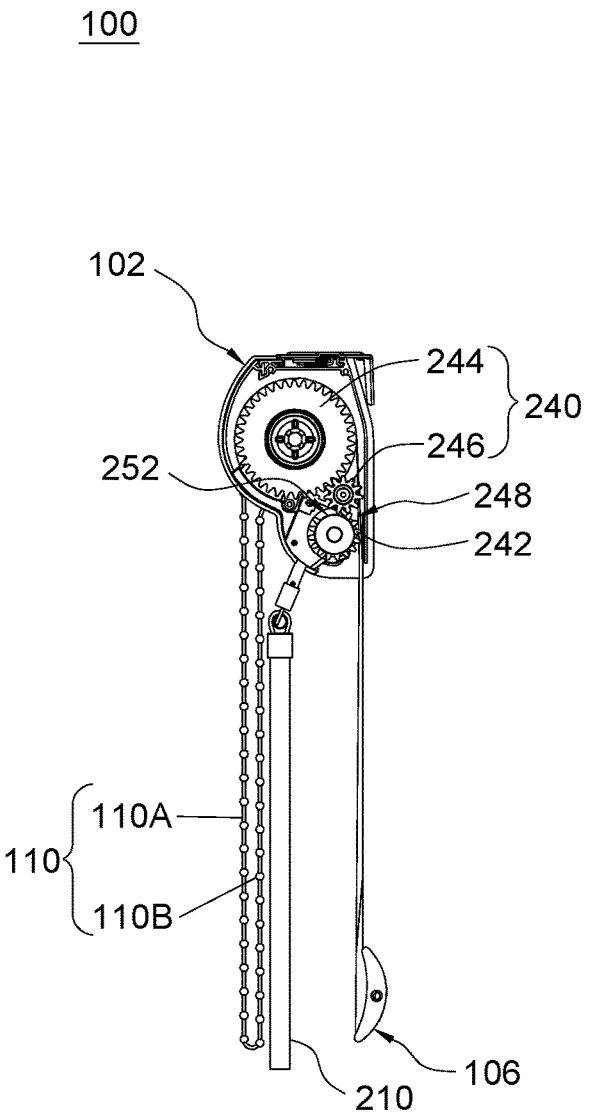

Referring to FIG. 23, for switching the panel assembly 104 from the open state to the closed state, a user can reversely rotate the operating member 210 about its lengthwise axis. As a result, the control module 204 can concurrently drive the lift actuator 202 and the switching part 242 to rotate in unison in the other direction, which causes the panel assembly 104 to switch to the closed state and the drive transmission portion 248 of the switching part 242 to disengage from the transmission member 246.

According to another operating method, a user can use the operating member 110 for switching the panel assembly 104 to the closed state. More specifically, the user can pull the outer portion 110B of the operating member 110 downward, so that the control module 130 can drive the reel 128 in rotation for unwinding the panel assembly 104. During an initial stage of this operation, the reel 128 is rotationally coupled to the lift actuator 202 via the switching part 242 and the transmission assembly 240, so the switching part 242 and the lift actuator 202 can also be driven in rotation for switching the panel assembly 104 to the closed state. The switching part 242 can rotate until the drive transmission portion 248 disengages from the transmission member 246.

Advantages of the window shade described herein include the ability to adjust a vertical position of the panel assembly and close and open the panel assembly at any desired height. The vertical displacement of the panel assembly and its switching between the closed and open state can be actuated independently with two different operating members. Moreover, the window shade has a construction that is reliable and can prevent improper operation of the window shade.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A window shade comprising:

a reel coupled to a first control module, the first control module including a first operating member that is exposed and is operable to drive the reel in rotation;

a panel assembly connected with the reel and including a plurality of transversal vanes respectively connected with a first and a second panel, the panel assembly having an open state for light passage and a closed state blocking light passage, and the reel being rotatable to wind and unwind the panel assembly;

a lift actuator coupled to a second control module and having a surface movable to release or clamp the panel assembly, the second control module including a second operating member that is exposed and is operable independently from the first control module to drive the lift actuator in rotation, the lift actuator being rotatable in a first direction to urge the first panel to slide relative to the second panel for switching the panel assembly to the open state, and in a second direction to release the first panel for switching the panel assembly to the closed state, the second operating member being different from the first operating member in shape; and a switchable coupling mechanism having a coupling state and an uncoupling state, the coupling mechanism rotationally coupling the lift actuator to the first control module in the coupling state and rotationally uncoupling the lift actuator from the first control module in the uncoupling state, wherein the coupling mechanism includes a switching part that is rotationally coupled to the lift actuator and has a drive transmission portion, and a transmission assembly coupled to the first control module and including a transmission member, the drive transmission portion of the switching part being engaged with the transmission member in the coupling state and disengaged from the transmission member in the uncoupling state;

wherein the window shade has a first configuration in which the panel assembly is in the closed state and the coupling mechanism is in the uncoupling state, and a second configuration in which the panel assembly is in the open state and the coupling mechanism is in the coupling state, the first operating member being operable to drive the reel in rotation for displacing the panel assembly independently of the lift actuator in the first configuration, and the first operating member being operable to cause the lift actuator to rotate for releasing the first panel in the second configuration.

2. The window shade according to claim 1, wherein the first control module is operable to drive the lift actuator in rotation for switching the panel assembly from the open state to the closed state while the coupling mechanism is in the coupling state, the coupling mechanism being switched to the uncoupling state when the panel assembly reaches the closed state.

3. The window shade according to claim 1, wherein the second control module is operable to drive the lift actuator in rotation and cause the coupling mechanism to switch between the coupling state and the uncoupling state.

4. The window shade according to claim 1, wherein the switching part and the lift actuator are rotatable about a same pivot axis.

5. The window shade according to claim 1, wherein the switching part includes a gap adjacent to the drive transmission portion, and the transmission member is rotatable through the gap without imparting rotation to the switching part in the uncoupling state.

6. The window shade according to claim 1, wherein the drive transmission portion of the switching part includes a plurality of teeth, and the transmission member is a gear, the drive transmission portion being engaged with the gear in the coupling state and disengaged from the gear in the uncoupling state.

7. The window shade according to claim 6, wherein the transmission assembly further includes a second gear that is coupled to the first control module and meshes with the transmission member, and the switching part includes a gap adjacent to the drive transmission portion, the transmission member being engaged with the drive transmission portion in the coupling state, the transmission member further being rotatable through the gap without imparting rotation to the switching part in the uncoupling state.

8. The window shade according to claim 7, wherein the first control module includes an actuating wheel connected with the first operating member, the first operating member being operable to drive the actuating wheel in rotation, the actuating wheel being rotatable to drive the reel to rotate for winding or unwinding the panel assembly, and the second gear being rotationally coupled to the actuating wheel.

9. The window shade according to claim 8, wherein the actuating wheel and the second gear are coaxial to the reel.

10. The window shade according to claim 1, wherein the switching part is fixedly connected with a shaft that is disposed coaxial to the lift actuator, the second operating member is a wand, and the second control module includes a worm rod pivotally connected with the wand, and a helical gear meshed with the worm rod, the helical gear and the lift actuator being rotationally coupled to the shaft.

11. The window shade according to claim 1, further including a limiting structure configured to stop the lift actuator in the closed state and the open state of the panel assembly, the limiting structure further preventing rotation of the reel for winding the panel assembly when the panel assembly is in the open state and the drive transmission portion of the switching part is engaged with the transmission member.

12. The window shade according to claim 11, wherein the switching part further has a protrusion, the limiting structure contacting against the protrusion of the switching part in the open state of the panel assembly to prevent rotation of the lift actuator in the first direction and rotation of the reel for winding the panel assembly.

13. The window shade according to claim 1, wherein the first operating member is a closed-loop operating member, and the second operating member is a wand.

14. The window shade according to claim 1, wherein the second operating member is a wand, and the second control module includes a worm rod connected with the wand, and a helical gear disposed coaxial to the lift actuator, the helical gear being rotationally coupled to the lift actuator and meshed with the worm rod.

15. The window shade according to claim 1, further including a head frame having a sidewall, the reel and the lift actuator being assembled in the head frame, a portion of the panel assembly being clamped between the lift actuator and the sidewall of the head frame in the open state.

16. A window shade comprising:

a reel coupled to a first control module, the first control module including a first operating member that is exposed and is operable to drive the reel in rotation;

a panel assembly connected with the reel and including a plurality of transversal vanes respectively connected with a first and a second panel, the panel assembly having an open state for light passage and a closed state blocking light passage, and the reel being rotatable to wind and unwind the panel assembly;

a lift actuator coupled to a second control module and having a surface movable to release or clamp the panel assembly, the second control module including a second operating member that is exposed and is operable independently from the first control module to drive the lift actuator in rotation, the lift actuator being rotatable in a first direction to urge the first panel to slide relative to the second panel for switching the panel assembly to the open state, and in a second direction to release the first panel for switching the panel assembly to the closed state, the second operating member being different from the first operating member in shape; and a switchable coupling mechanism having a coupling state and an uncoupling state, the coupling mechanism rotationally coupling the lift actuator to the first control module in the coupling state and rotationally uncoupling the lift actuator from the first control module in the uncoupling state, wherein the coupling mechanism includes a switching part that is rotationally coupled to the lift actuator and has a drive transmission portion, and a transmission assembly coupled to the first control module and including a transmission member, the drive transmission portion of the switching part being engaged with the transmission member in the coupling state and disengaged from the transmission member in the uncoupling state;

wherein the first operating member is operable to drive the lift actuator in rotation for switching the panel assembly from the open state to the closed state while the coupling mechanism is in the coupling state, the coupling mechanism being switched to the uncoupling state when the panel assembly reaches the closed state, and the second operating member is operable to drive the lift actuator in rotation and cause the coupling mechanism to switch between the coupling state and the uncoupling state.

17. The window shade according to claim 16, wherein the switching part includes a gap adjacent to the drive transmission portion, and the transmission member is rotatable through the gap without imparting rotation to the switching part in the uncoupling state.

18. The window shade according to claim 16, wherein the drive transmission portion of the switching part includes a plurality of teeth, and the transmission member is a gear, the drive transmission portion being engaged with the gear in the coupling state and disengaged from the gear in the uncoupling state.

* * * * *